US006531268B1

(12) United States Patent
Hirabayashi

(10) Patent No.: US 6,531,268 B1
(45) Date of Patent: Mar. 11, 2003

(54) PHOTOTHERMOGRAPHIC MATERIAL

(75) Inventor: Kazuhiko Hirabayashi, Hino (JP)

(73) Assignee: Konica Corporation (JP)

( * ) Notice: Subject to any disclaimer, the term of this patent is extended or adjusted under 35 U.S.C. 154(b) by 63 days.

(21) Appl. No.: 09/636,798

(22) Filed: Aug. 11, 2000

(30) Foreign Application Priority Data

Aug. 19, 1999 (JP) ..... 11-232667

(51) Int. Cl.[7] ..... G03C 5/16; G03D 13/00

(52) U.S. Cl. ..... 430/350; 430/531; 430/619; 396/575; 396/577

(58) Field of Search ..... 430/350, 619, 430/531; 396/575, 571, 577; 219/216

(56) References Cited

U.S. PATENT DOCUMENTS 5,774,204 A 6/1998 Suzuki et al.

FOREIGN PATENT DOCUMENTS

| | | |
|---|---|---|
| EP | 0803766 | 10/1997 |
| EP | 0902322 | 3/1999 |
| WO | 9728487 | 7/1997 |

OTHER PUBLICATIONS

European Search Report EP 00 30 7076.

*Primary Examiner*—Thorl Chea
(74) *Attorney, Agent, or Firm*—Bierman, Muserlian and Lucas

(57) ABSTRACT

A processing method of a photothermographic material is disclosed comprising subjecting the photothermographic material to heat development by the use of a thermal processing apparatus, wherein the photothermographic material comprises a support, organic silver salt particles, light sensitive silver halide grains, a reducing agent and a contrast-increasing agent; and after having been subjected to heat development, the photothermographic material exhibits a distortion of not more than 0.03 degree. A thermal processing apparatus for the photothermographic material is also disclosed.

12 Claims, 4 Drawing Sheets

PHOTOTHERMOGRAPHIC MATERIAL

FIELD OF THE INVENTION

The present invention relates to thermally developable photothermographic materials and a processing method thereof.

BACKGROUND OF THE INVENTION

Plate-making work has undergone remarkable changes from manual work to electronic stripping. In such a trend, plotters such as an image setter have rapidly come into wide use. A processing machine for conventional silver salt photographic materials is connected on line to such a precision instrument, producing problems that gas or moisture from the processing solution causes the substrate to corrode, resulting in an increase of troubles in expensive instruments.

In conventional silver salt photographic materials, water supply piping is needed for dilution of developer and fixer solutions as well as washing and recovery of processing effluents by dealers requires much time and labor.

A dry processing system without using water is expected from such a background. Among various dry processing systems, thermal processing is most suitable for practical use in terms of manufacturing cost and performance. However, photothermographic materials are sensitive to variations of temperature in the thermal processing section. Maintaining a uniform temperature of the heated drum surface leads to enhanced quality of finished prints, as is disclosed in JP-A 9-297384 and 9-297385 (hereinafter, the term, JP-A refers to an examined and published Japanese Patent Application).

In this technique, however, maintaining a uniform surface temperature of the drum results in non-uniformity in thermal expansion or shrinkage of the photographic material, leading to the distorted photographic material after thermal processing and producing a problem that moiré images tend to occur after thermal processing, which are not suited to the use for plate-making. Specifically, in cases when used in color printing, such a problem is marked.

Thermal plastic resin, specifically, polyethylene terephthalate (also simply denoted as PET) is employed as a support material for photothermographic materials, in terms of low cost and superior film-making property. However, the use of such a support often causes moiré. The glass transition point (Tg) of such a resin is ca. 80° C. and the photothermographic materials are thermally processed usually at a temperature of 100° C. or higher. It is assumed that such moiré is caused by deformation of the photographic material accompanied with shrinkage or elongation of the support. Thus, it is contemplated that deteriorated dimensional stability causes moiré images. To enhance dimensional stability, it has been attempted to improve thermal variation of the ratio of the dimension in the winding direction to that in the width direction (MD/TD) in the course of preparing the support, e.g., as disclosed in JP-A 10-10676 and 10-10677. However, there was not obtained sufficiently satisfactory stability only by such a technique.

SUMMARY OF THE INVENTION

As a result of the inventors' study, it was proved that deformation caused by distortion markedly affects dimensional stability and that the distortion (or deformation) of a support could not be definitely determined by taking the distance between two points corresponding to the perpendicular direction and the parallel direction to the width of the film support. When a support such as PET base is subjected to biaxial stretching in the preparation thereof, for example, the MD direction is cooled and fixed while being stretched. When developed at a temperature higher than the glass transition point (Tg), the support is softened and tends to shrink in the MD direction and elongate in the TD direction. There have been known a trial of reducing the thermal dimensional change in the MD and TD directions, as aforementioned. However, superior quality print images cannot be obtained by only such a technique. In cases when deformed in such a manner as shown in FIG. 1-2, for example, although no dimensional change occurs in either the MD or the TD direction, the square still is deformed, i.e., distortion is caused. The fact that the dimensional change (MD/TD) is small but the printed images are nevertheless inferior is presumed to be due to occurrence of the distortion described above. The thus produced distortion appears as a phenomenon of so-called moiré, resulting in deterioration of printed images. Thus, the present invention was achieved based on noting that the dimensional stability of the photothermographic material could not be enhanced to sufficiently satisfactory levels without improvements not only in the MD/TD but also in the distortion of the photothermographic material.

It is an object of the present invention to improve distortion of the photothermographic material. It was proved that when the distortion was represented as an angle and the difference in angle between before and after being processed with respect to three corners of the square being within 0.03°, deterioration of printed images was not visually detected.

It was noted that achievement of holding the distortion of the photothermographic material to within 0.03 degree includes an approach of devising installation of heaters or a heating procedure in a thermal processing apparatus, and an approach of improving the photothermographic material itself, whereby improvements of a thermal processing apparatus, a thermal processing method and a photothermographic material were accomplished. It was further proved that in the case of improving the photothermographic material, an improvement in the support largely affected the distortion angle and improvement in an image forming layer or a constituting layer also affected the distortion angle.

When angles at three corners of a 10 cm square, as shown in (a), (b) and (c) of FIG. 1 are measured before and after being thermally processed, the distortion defined in this invention refers to the maximum of the values at the three corners with respect to the difference in angle between before and after being thermally processed. The distortion can be determined in such a manner that 10 cm squares are measured as many as possible, in the width direction of the photothermographic material (preferably, in the perpendicular direction to the transport direction of the photothermographic material in the thermal processing apparatus, and more preferably in the width direction of the support roll; herein), and judgment is made based on whether the distortion is within 0.03° or not. In the case of 590 mm of the width of a photothermographic material, for example, five pieces of a 10 cm square are cut from the width direction of the unprocessed photothermographic material. With regard to each of these squares, the difference in angle between before and after being thermally processed, at the three corners (i.e., a, b and c) is within 0.03° (and preferably within 0.017°). Since fluctuation is negligible in the transport direction, there is no need of plural sampling in the transport direction. Herein, the width direction refers to the laterally stretching direction in the biaxial stretching of the support and the transport direction refers to the longitudinally stretching direction.

When 10 cm squares are samples from a few locations within the size of a newspaper sheet and the difference in angle was measured, for example, if no variation in the angle occurs (i.e., in the case of being a similar figure), the overall space is said not to be distorted, though the size of the squares may differ. However, such a case almost never occurs. The distortion occurs non-uniformly so that it can be determined by measuring the angle at each of these three points. FIG. 1-1 illustrates distortion as defined in this invention, in which the variation in angle between before and after being processed may be within 0.03° at the three points a, b and c.

Accordingly, it is an object of the present invention to provide photothermographic materials exhibiting improved dimensional stability and no moiré images after being processed, a processing method and a thermal processing apparatus by the use thereof.

The object of the invention can be accomplished by the following constitution:

1. A method for processing a photothermographic material comprising the step of:
   subjecting the photothermographic material to heat development by the use of a thermal processing apparatus,
   wherein the photothermographic material comprises a support, organic silver salt particles, light sensitive silver halide grains, a reducing agent and a contrast-increasing agent; and after being subjected to heat development, the photothermographic material exhibits a distortion of not more than 0.03 degree;
2. The processing described in 1, wherein the thermal processing apparatus comprises a heat-developing section to heat-develop the photothermographic material, the heat-developing section contains at least three heaters which are independently capable of controlling temperature;
3. The processing method described in 2, wherein the three heaters are arranged in the direction substantially vertical to the transporting direction of the photothermographic material;
4. The processing method described in 1, wherein the thermal processing apparatus further comprises a cooling section to cool the heat-developed photothermographic material, and the cooling section contains at least two coolers which are independently capable of controlling temperature;
5. The processing method described in 4, wherein the two coolers are arranged in the direction substantially vertical to the transporting direction of the photothermographic material;
6. The processing method described in 1, wherein the photothermographic material comprises an image forming layer, the image forming layer comprises the organic silver salt particles, the light sensitive silver halide particles and a binder, and at least 50% by weight of the binder is accounted for by a polymer latex exhibiting a glass transition point of, less than 40° C.;
7. The processing method described in 1, wherein the photothermographic material comprises an image forming layer, the image forming layer comprises the organic silver salt particles, the light sensitive silver halide particles and a binder, and at least 50% by weight of the binder is accounted for by a polymer latex exhibiting a glass transition point of not less than 40° C.;
8. The processing method described in 1, wherein after subjected to heat development, the photothermographic material exhibits a distortion of not more than 0.017 degree;
9. The processing method described in 1, wherein said support is one which was previously subjected to a thermal treatment at a temperature of 110 to 190° C. over a period of 15 to 30 min., while being transported under a tension of 2 to 6 kg/cm$^2$;
10. The processing method described in 9, wherein the photothermographic material comprises an image forming layer; the image forming layer is coated on the support and wound up at a tension of 20 to 60 kg/cm$^2$, and
11. A thermal processing apparatus for heat-developing a photothermographic material comprising a heat-developing section to heat-develop the photothermographic material, the heat developing section having at least three heaters, wherein the three heaters are independently capable of controlling temperature, the three heaters being arranged in the direction substantially vertical to the transporting direction of the photothermographic material;
12. The thermal processing apparatus described in 11, wherein the apparatus further comprises a cooling section to cool the heat-developed photothermographic material, the cooling section having at least two coolers; and the two coolers are independently capable of controlling temperature and being arranged in the direction substantially vertical to the transporting direction of the photothermographic material;
13. A photothermographic material comprising a support, organic silver salt particles, light sensitive silver halide grains, a reducing agent and a contrast-increasing agent, wherein after having been subjected to heat-development by the use of a thermal processing apparatus, the photothermographic material exhibits a distortion of not more than 0.03 degree;
14. The photothermographic material described in 13, wherein the photothermographic material is subjected to heat-development at a temperature of 30 to 150° C. in the thermal processing apparatus;
15. The photothermographic material described in 13, wherein the photothermographic material comprises an image forming layer, the image forming layer comprises the organic silver salt particles, the light sensitive silver halide particles and a binder, and at least 50% by weight of the binder is accounted for by a polymer latex exhibiting a glass transition point of less than 40° C.;
16. The photothermographic material described in 13, wherein the photothermographic material comprises an image forming layer, the image forming layer comprises the organic silver salt particles, the light sensitive silver halide particles and a binder, and at least 50% by weight of the binder is accounted for by a polymer latex exhibiting a glass transition point of not less than 40° C.;
17. The photothermographic material described in 13, wherein said support is one which was previously subjected to a thermal treatment at a temperature of 110 to 190° C. over a period of 15 to 30 min., while being transported with applying a tension of 2 to 6 kg/cm$^2$;

18. The photothermographic material described in 13, wherein the photothermographic material comprises an image forming layer, the image forming layer being coated on the support and wound up at a tension of 20 to 60 kg/cm$^2$;

19. The photothermographic material described in 13, wherein after subjected to heat development, the photothermographic material exhibits a distortion of not more than 0.017 degree;

20. A processing method of a photothermographic material comprising a support having thereon organic silver salt particles, light sensitive silver halide grains, a reducing agent and a contrast-increasing agent, wherein the photothermographic material exhibits a distortion of not more than 0.03 degree;

21. The processing method described in 20, wherein a thermal processor having heat sources above and below the transport path has at least three sections per one side which are independently capable of controlling temperature above and below the developing path;

22. The processing method described in 20 or 21, at least two sections independently capable of controlling temperature are provided in the cooling process of cooling of the processor;

23. A method for processing a photothermographic material comprising a support having thereon organic silver salt particles, light sensitive silver halide grains, a reducing agent and a contrast-increasing agent, wherein the photothermographic material exhibits a distortion of not more than 0.03 degree after being processed and a binder contained in an image forming layer of the photothermographic material is mainly comprised of a polymer latex having a glass transition point of not less than 40° C.; the photothermographic material is processed by the use of a thermal processor having at least three sections perorle side which are independently capable of controlling temperature above and below the developing path;

24. A method for processing a photothermographic material comprising a support having thereon organic silver salt particles, light sensitive silver halide grains, a reducing agent and a contrast-increasing agent, wherein the photothermographic material exhibits a distortion of not more than 0.03 degree after being processed and a binder contained in an image forming layer of the photothermographic material is mainly comprised of a polymer latex having a glass transition point of not less than 40° C.; the photothermographic material is processed by the use of a thermal processor, in which at least two sections independently capable of controlling temperature are provided in the cooling process of cooling of the processor.

25. The method for processing a photothermographic material comprising a support having thereon organic silver salt particles, light sensitive silver halide grains, a reducing agent and a contrast-increasing agent described in any one of

(21) through (24), wherein the photothermographic material exhibits a distortion of not more than 0.017 degree.

BRIEF EXPLANATION OF THE DRAWING

FIGS. 2-1 through 2-3 illustrates a thermal processor used in the invention.

FIG. 3 indicates a measurement method of distortion.

EXPLANATION OF SYMBOLS

Figure 1:
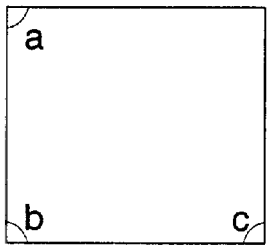
FIGS. 1-1 and 1-2 illustrate distortions in the invention.

PH: Pre-heating section
HD: Heat-developing section
CU: Cooling section
PHU: Upper heat source of pre-heating section
PHL: Lower heat source of pre-heating section
HDU: Upper heat source of heat-developing section
HDL: Lower heat source of heat-developing section

EMBODIMENT OF THE INVENTION

The thermally developable photothermographic materials used in this invention will be described in detail. The photothermographic material is exposed to light to form a latent image and then thermally developed to form silver images.

In the photothermographic material and the processing method according to this invention, the photothermographic material, after having been subjected to heat development, exhibits a distortion of not more than 0.03 degree (and preferably not more than 0.017 degree). To achieve the distortion of the thermally processed photothermographic material being within 0.03 degree includes an approach of devising installation of heaters or coolers, or a heating or cooling procedure in a thermal processing apparatus, and an approach of improving the photothermographic material itself.

First, improvements of the thermal processing apparatus will be described. The thermal processing apparatus includes a heat-developing section to heat-develop a photothermographic material. The heat-developing section preferably includes at least three heaters which are independently capable of controlling temperature. These three heaters, which provide heat to the photothermographic material, are preferably arranged in the perpendicular direction to the transport direction of the photothermographic material in the thermal processing apparatus. Further, the three heaters capable of being independently temperature-controlled are preferably provided on the same side. Examples of the same side include the side facing the image forming layer of the photothermographic material, the side facing the surface opposite of the image forming layer, top face side, bottom face side, right face side and left face side. In FIG. 2-2, for example, six heaters are provided on the side of the top face side, and in FIG. 2-3, six heaters are provided on the side of the bottom face. Further, on each of facing both sides are more preferably provided at least three heaters (i.e., at least six heaters in total). In these cases, if at least three heaters are independently temperature-controllable, the other heaters may not be temperature-controllable.

It is preferred that the thermal processing apparatus further comprises a pre-heating section for pre-heating the photothermographic material prior to heat-development and a cooling section for cooling the photothermographic material after heat development. The pre-heating section and the cooling section may be or may not be clearly distinguishable from each other in terms of the constitution of the apparatus. In cases where they are indistinguishable, it is preferred that when the maximum heating temperature is denoted as Tmax (° C.), the section within the heating temperature range of Tmax minus 5° C. to Tmax is regarded as the heat-developing section and a section of less than Tmax minus 5° C. which is prior to the heat-developing section in the course of transport is regarded as the pre-heating section. The thermal processing apparatus preferably further comprises a transport section for transporting the photothermographic material.

In cases where after having been heat-developed, the photothermographic material is cooled in the cooling section, it is preferred that the distortion after cooling exhibits not more than 0.03 degree. Specifically, it is preferred that after having been subjected to the total processing in the thermal processing apparatus, the photothermographic material exhibits a distortion of not more than 0.03 degree. The cooling section preferably contains at least two coolers which are capable of independently controlling temperature. In these cases, if at least two coolers are independently temperature-controllable, the other coolers may not be temperature-controllable. The two coolers are preferably arranged in the perpendicular direction to the transport direction of the photothermographic material in the thermal processing apparatus.

The temperature control in the heater includes not only varying the heating temperature of the heater but also varying the heating duration. It may be done by detecting the heating temperature and may not include controlling the heating temperature itself. For example, it may be accomplished by controlling the current supplied to the heater. Alternatively, it may be a rough control, such as raising or lowering the temperature itself. In cases of containing at least three heaters independently capable of controlling the temperature, the heating section may be divided to at least three heating temperature (or heating time) regions. In this case, the heaters may not be different in temperature from each other. In cases where six heaters are arranged in the direction perpendicular to the transport direction of a photothermographic material, as shown in FIG. 2-2, for example, the heating temperature of HDU-1 and HDU-2 is $T_1$° C., that of HDU-3 and HDU-4 is $T_2$° C. and that of HDU-5 and HDU-6 is $T_3$° C. Alternatively, the heating temperature of HDU-1 and HDU-2 is $T_1$° C., that of HDU-3 and HDU-4 is $T_2$° C. and that of HDU-5 and HDU-6 is the same as HDU-1 and HDU-2, $T_1$° C. Further, each of HDU-1 through HDU-6 may be different in temperature from the other, or the heating temperature of HDU-1, HDU-3 and HDU-5 may be $T_1$° C. and that of HDU-2, HDU-4 and HDU-6 may be $T_2$° C. Specifically, it is preferred that of plural heaters, both ending heaters (e.g., HDU-1 and HDU-6 in FIG. 2-2) are higher in temperature than the other heaters.

The temperature control in the cooler includes not only varying the cooling temperature of the cooler but also varying the cooling time. It may be simply detecting the cooling temperature and may not include controlling the cooling temperature itself. For example, it may be allowed to control the current supplied to the heater. Alternatively, it may be a rough control, such as raising or lowering the temperature itself. In case of containing at least two coolers capable of independently controlling the temperature, the cooling section may be divided into at least two cooling temperature (or heating time) regions. In this case, the coolers may not differ in temperature from each other.

Thermal plastic resin such as a PET base used for a support of the photothermographic material tends to shrink in the MD direction when exposed to a high temperature and elongate when further exposed to a higher temperature. Thus, the extent of shrinkage or elongation at the time of heating is different, depending of the location of the photothermographic material. The shrinkage or elongation of the photothermographic material can be controlled by locally controlling the heating temperature (or heating time) or the cooling temperature (or cooling time) in response to the difference in local shrinkage or elongation, thereby leading to reduced distortion. For example, it is so controlled that a portion of the photothermographic material which tends to elongate on heating is heated at a lower temperature and a portion which tends to not elongate so much is heated at a higher temperature. Thus, the distortion of the support or the photothermographic material can be reduced by optimal control of the heating temperature or time, or the cooling temperature or time at specific plural locations.

Preferred examples of the heater used in this invention include a self-exothermic type one such as a ceramic heater, one in which a heater is attached to a heat transmission member, such as a rubber heater and one which indirectly heats a heat transmission member through convectional heat transmission from hot air, and one which heats a heat transmission member through radiation by using a halogen lamp. The length in the transport direction of the heat-developing section, depending of the line-speed, is preferably 100 to 1,000 mm, and more preferably 200 to 700 mm. The length of the pre-heating section is preferably 100 to 1,000 mm, and more preferably 200 to 700 mm. With regard to the number and arrangement of the heaters, although more heated leads to more precise control, the number of heaters is preferably 3 or more, more preferably 3 to 10 for one side, and still more preferably 3 to 10 for each of both sides. More heaters are preferably arranged in the perpendicular direction (i.e., the width direction) to the transport direction. However, arrangements such as 2×3, 3×3 or 4×2 are also feasible.

As a cooler used in this invention, for example, it is preferred to allow to be brought into contact with a highly heat-conductive metal plate such as aluminum or stainless steal to cool this member. Self-cooling may be feasible but it is preferred to cool the metal plate by aerial convection (e.g., fan). It is also feasible to directly cool the photothermographic material by aerial convection (e.g., a fan). With regard to the number and arrangement of the coolers, although the coolers used leads to more precise control, the number of coolers is preferably 2 to 6 for at least one side, and more preferably 2 to 6 for each of both sides. The coolers are preferably arranged in the perpendicular direction (i.e., the width direction) to the transport direction. However, arrangements such as 2×3 or 3×2 are feasible.

In cases where being transported by opposed rollers, the upper and lower rollers can be arranged in parallel to each other. Further, when the roller bearing portion is allowed to move slightly up and down, right and left to adjust the roller position up and down, right and left, tension to the photographic material is varied, enabling reduction of the distortion thereof. Further, in this case, slightly changing the outer diameter of rollers or the gear diameter to differentiate the circumferential speed with respect to other rollers results in varying tension applied to the photographic material, enabling to reduce the distortion.

In the heat-developing section, it is preferred to employ a panel heater and to insulate it using heat insulating material such as glass wool. In the transport section, rubber rollers are preferably used to prevent wrinkling or uneven development. The thickness of the rubber roller is preferably 1 to 10 mm. The transport can be conducted only by either the upper rollers or only the lower rollers. In cases when being transported by the upper rollers, it is desirable to use the lower-rollers exhibiting superior slipping property. A panel heater attached with a raising fabric such as veludo is preferred. Belt transport is also applicable. The transport speed is preferably 10 to 50 mm/min, and more preferably 23 to 40 mm/min. The roller nipping pressure is preferably 0.1 to 25 kg/m, and more preferably 0.2 to 15 kg/m.

A heat drum system and heated roller system are applicable. For example, it is possible to reduce the distortion by dividing the heat drum to undergo heat-control or by dividing the heat roller in the width direction to undergo temperature control. In cases when the distortion is reduced to a sufficient level by improvement of the photothermographic material, conventional heat drum system and heat drum system are applicable.

Next, improvements in the photothermographic material will be described. The photothermographic material relating to this invention comprises a support, organic silver salt particles, light-sensitive silver halide grains, a reducing agent and a contrast-increasing agent. After heat-developed in a thermal processing apparatus, the photothermographic material exhibits a distortion of not more than 0.03 degree (and preferably not more than 0.017 degree). The heat-developing temperature in the thermal processing apparatus is preferably 30 to 150° C. The photothermographic material preferably comprises on the support an image forming layer. The image forming layer contains organic silver salt particles, light-sensitive silver halide grains and binder. A reducing agent and a contrast-increasing agent are also preferably contained therein. The photothermographic material may comprise a component layer other than the image forming layer. Examples of the component layer include a sublayer, an antistatic layer, a protective layer, and a cushion layer. The reducing agent and contrast-increasing layer may be contained in an adjacent layer to the image forming layer.

The photothermographic material is stable at ordinary temperatures, which is, after exposure to light, developed on heating at a high temperature. The photothermographic material is heated to form silver through oxidation-reduction reaction between an organic silver salt (functioning as an oxidizing agent) and a reducing agent. The oxidation-reduction reaction is catalyzed by a silver latent image produced in silver halide on exposure to light. Silver produced in exposed areas through reaction of the organic silver salt provides a black image, contrasting with non-exposed areas. Such a reaction process can proceed without supplying a processing solution such as water.

At least 50% by weight of the binder of the image forming layer may be accounted for by a polymeric latex exhibiting a glass transition point of less than 40° C., or at least 50% by weight of the binder of the image forming layer may be accounted for by a polymeric latex exhibiting a glass transition point of not less than 40° C.

The support used in the photothermographic material is preferably one which has been subjected in advance to a thermal treatment at a temperature of 110 to 190° C. for a period of 15 to 30 min., while being transported with applying a tension of 2 to 6 kg/cm$^2$. It is preferred that the image forming layer be coated on the support and wound up under a tension of 20 to 60 kg/cm$^2$.

The distortion of the support used in this invention tends to decrease after being subjected to thermal relaxation. Thermal treatment at a temperature of 110 to 190° C. results in sufficient thermal relaxation without resulting in wrinkling or elongation. The thermal treatment duration is preferably 15 to 30 min., based on the foregoing reason. The transport tension at the thermal treatment is preferably 2 to 6 kg/cm$^2$.

In the course of drying the image forming layer, the photothermographic material reaches a temperature of 60 to 90° C., at which it is preferred to wind up at a tension of not more than 60 kg/cm$^2$, thereby maintaining the effects of the thermal treatment.

In this invention, at least an image forming layer preferably contains a polymeric latex in an amount of not less than 50% by weight, based on the whole binder of this image forming layer. The polymeric binder used in this invention can be incorporated not only into the image forming layer, but also into a protective layer or a backing layer. Specifically in cases where the photothermographic material according to this invention is used in the field of graphic arts, it is preferred to incorporate the polymeric latex not only into the image forming layer but also into the protective layer and backing layer, in terms of dimensional change characteristics.

The polymeric latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion. The polymeric latexes are described in "Synthetic Resin Emulsion" (edited by T. Okuda and h. Inagaki, published by KOBUNSHI-KANKOKAI, 1978), "Application of Synthetic Latex" (edited by Sugimura et al., published by KOBUNSHI-KANKOKAI, 1993), and "Chemistry of Synthetic Latex" (S. Muroi, published by KOBUNSHI-KANKOKAI, 1970).

The mean particle size of dispersing particles is 1 to 50,000 nm, and preferably 5 to 1,000 nm. The particle size distribution thereof is not specifically limited and may be polydisperse or monodisperse. The polymeric latexes used in the invention may be those having a uniform structure as well as core/shell type latexes. In this case, it is sometimes preferred that the glass transition temperature is different between the core and shell. The preferred range of the glass transition point (Tg) of the polymeric latexes used in this invention is different in the protective layer, image forming layer and the backing layer. The Tg of the image forming layer is not more than 40° C. to promote diffusion of photographically useful material on thermal development, and preferably 30 to 40° C. In cases where used in the protective layer or backing layer, the Tg is preferably 25 to 70° C. since the backing layer is brought into contact with various instruments. The minimum forming (or tarnishing) temperature (MFT) of the polymeric latexes is preferably 30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

There may be employed a polymeric latex exhibiting a glass transition point of not less than 40° C.

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an image forming layer such as a light-sensitive layer is insufficient, excessively large molecular weight results in deterioration in film forming property.

Exemplary examples of polymeric latexes used as binder include a latex of methylmethacrylate/ethylmethacrylate/ methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. Such polymers are commercially available, and examples of commercially available acryl resin include Sevian A-4635, 46583, and 4601 (available from DAISEL CHEMICAL INd. Ltd.) Nipol Lx811, 814, 821, 820, and 857 (available from NIHON ZEON Co. Ltd. Examples of polyester rein include FINETEX ES650, 611, 675, 850 (available from DAINIPPON INK CHEMICAL Co. Ltd.), and WD-size WMS (available from Eastman Kodak Corp.). Examples of polyurethane resin include HYDRAN AP10, 20, 30, 40 (available from DAINIPPON INK CHEMICAL Co. Ltd.). Examples of rubber resin include LACSTAR 7310K, 3307, 4700H, 7132C (available from DAINIPPON INK CHEMICAL Co. Ltd.); and Nipol Lx416, 410, 438C and 2507 (available from NIHON ZEON Co. Ltd.). Examples of vinylidene chloride resin include L502, L513 (available from ASAHI CHEMICAL IND. Co. Ltd.). Examples of olefin resin include CHEMIPAL s120, SA100 (available from MITSUI PETROLEUM CHEMICAL IND. Co. Ltd.). These polymers can be used alone or may be blendead.

The polymeric latex preferably accounts for at least 50%, and more preferably at least 70% by weight of the whole binder used in the image forming layer. In addition to the polymeric latex, hydrophilic polymers such as gelatin polyvinyl alcohol, methyl cellulose or hydroxypropyl cellulose may be optionally incorporated into the image forminglayer in an amount of not more than 50%, and preferably not more than 10% by weight of the whole binder. The hydrophilic polymer is incorporated preferably in an amount of not more than 30 wt %, and more preferably not more than 5 wt % of the whole binder.

In this invention, it is preferred the an aqueous coating solution is coated and dried to form the image forming layer. Herein, the expression "aqueous" means that at least 60% by weight of a solvent (dispersing medium) used in the coating solution is water. The solvent(s) used in the coating solution other than water include, for example, water-miscible organic solvents, such as methanol, ethanol, isopropanol, methyl cellosolve, ethyl cellosolve, dimethyl formamide and ethyl acetate. Examples of the solvent composition include water/methanol (90/10), water/methanol (70/30), water/ethanol (90/10), water/isopropanol (90/10), water/dimethyl formamide (95/5), water/methanol/dimethyl formamide (80/15/5), and water/methanol/dimethyl formamide (90/5/5), wherein the number means weight percentage.

In the case of using a polymeric latex exhibiting a glass transition point of not less than 40° C., it is preferred to coat a solvent type coating solution and dry it to form an image forming layer. The expression "solvent type" means that at least 60% by weight of the solvent used in the coating solution is accounted for by a water-inmiscible liquid.

The amount of the whole binder used in the image forming layer is preferably 0.2 to 30 g/m$^2$, and more preferably 1 to 15 g/m$^2$.

The photothermographic material used in this invention comprises on a support organic silver salt particles, light-sensitive silver halide grains, a reducing agent and a contrast-increasing agent, and a cross-linking agent for cross-linking and a surfactant to enhance coatability may optionally be contained.

The adjuvants described above will be further detailed. Exemplary preferred examples of the contrast-increasing agent include hydrazine derivatives, quaternary onium compounds and vinyl type compounds.

Preferred hydrazine derivatives are represented by the following formula (H):

Formula (H)

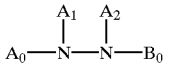

In the formula, $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=N$G_1D_1$)—, —SO—, —$SO_2$— or —P(O) ($G_1D_1$)— group, in which $G_1$ is a linkage group, or a —O—, —S— or —N($D_1$)—group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group., alkylthio group or arylthio group.

In Formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfonxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ of formula (H) is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiorhene-ring or furan-ring. In the —$G_0$—$D_0$ group represented by $A_0$, $G_0$ is a —CO—, —COCO—, —CS—, —C(=N$G_1D_1$)—, —SO—, —$SO_2$— or —P(O) ($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group, and preferred $D_0$ is a hydrogen atom, or an alkyl, alkoxyl or amino group. The aromatic group, heterocyclic group or —$G_0$—$D_0$ group represented by $A_0$ each may be substituted.

Specifically preferred $A_0$ is an aryl group or —$G_0$—$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably —$G_0$—$D_0$, wherein $G_0$ is a —CO—, —COCO—, —CS—, —C(=$NG_1D_1$)—, —SO—, —$SO_2$— or —P(O) ($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxyl or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

H-1

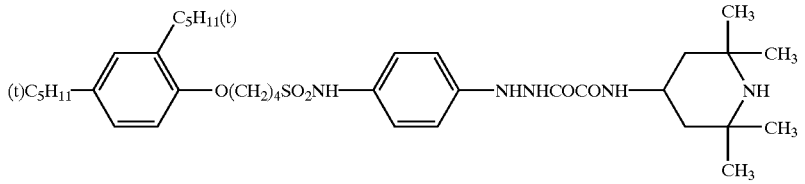

H-2

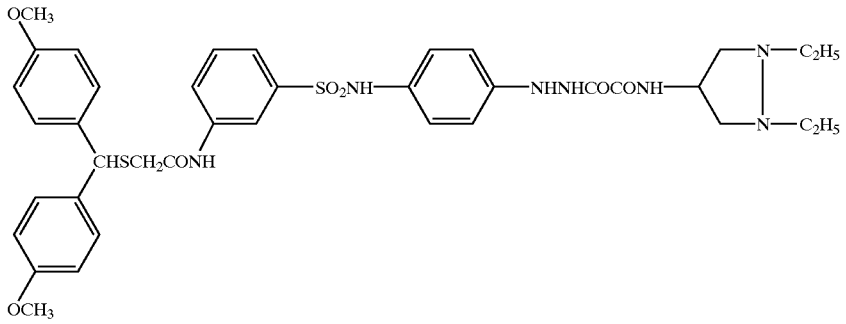

H-3

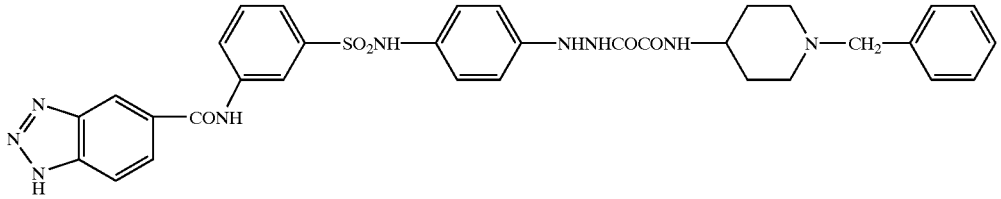

H-4

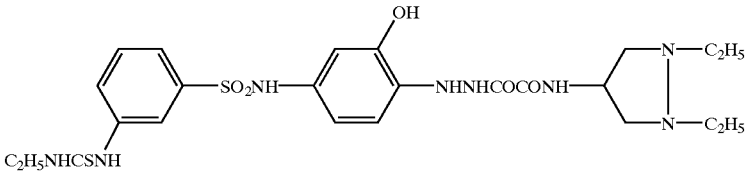

H-5

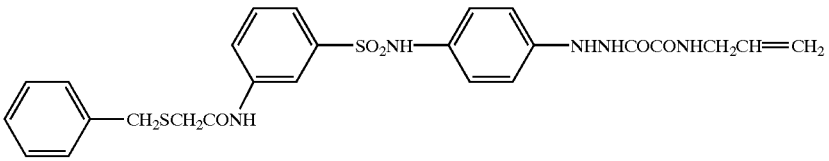

-continued
H-6
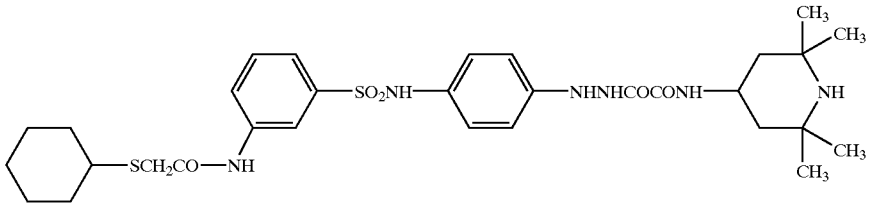
H-7
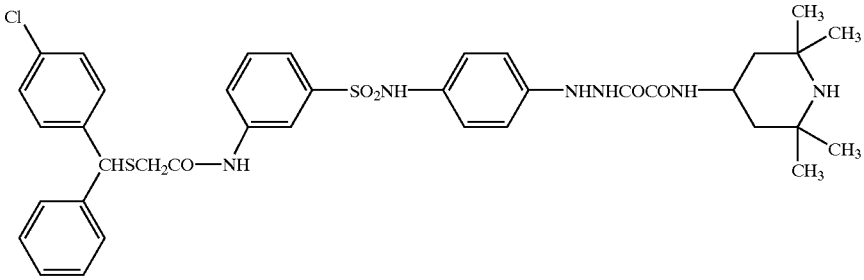
H-8
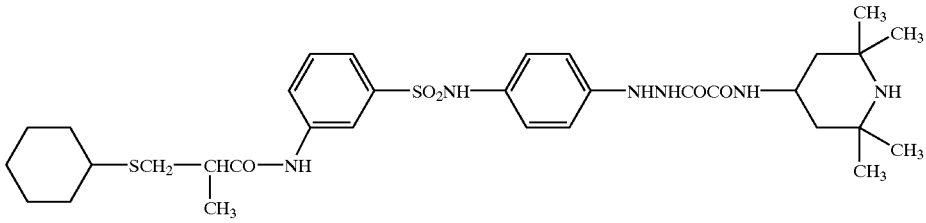
H-9
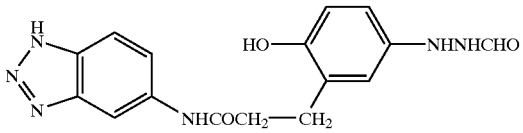
H-10
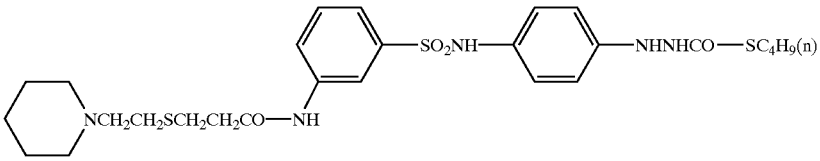
H-11
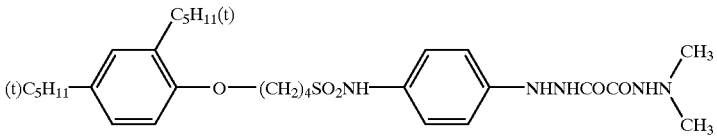
H-12
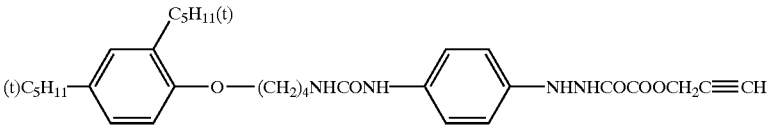
H-13
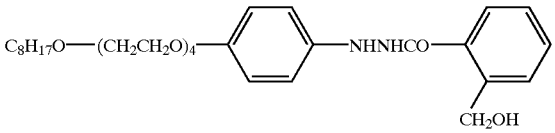

-continued
H-14
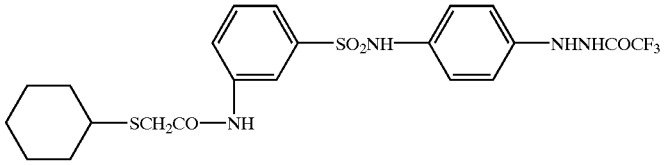
H-15
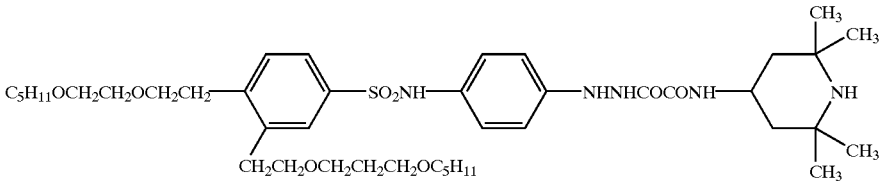
H-16
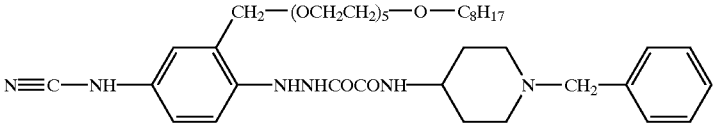
H-17
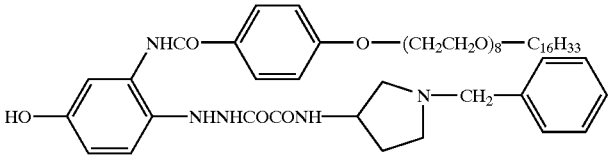
H-18
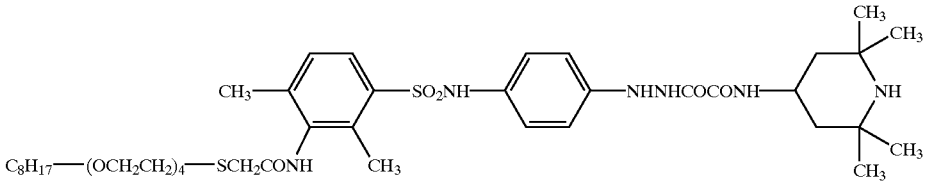
H-19
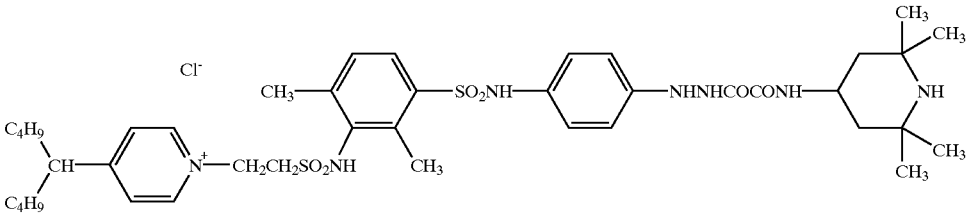
H-20
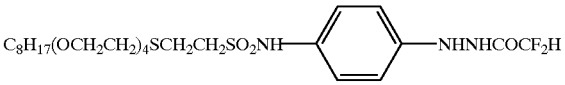
H-21
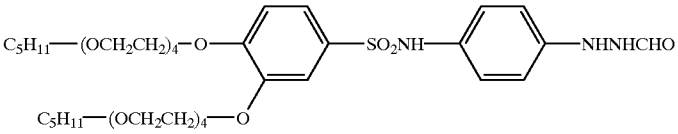
H-22
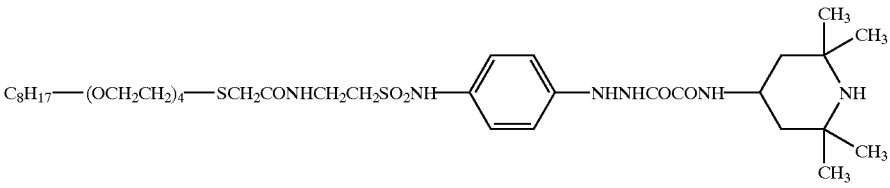

-continued
H-23
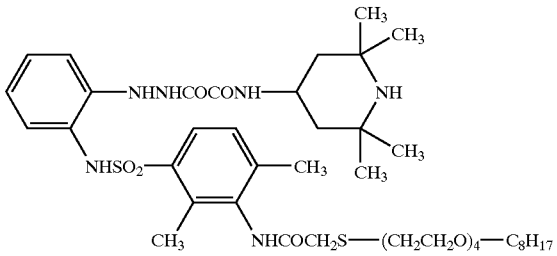
H-24
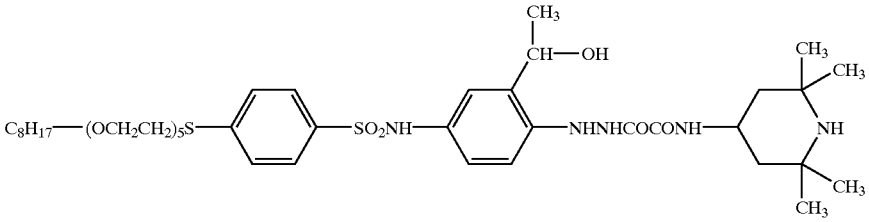
H-25
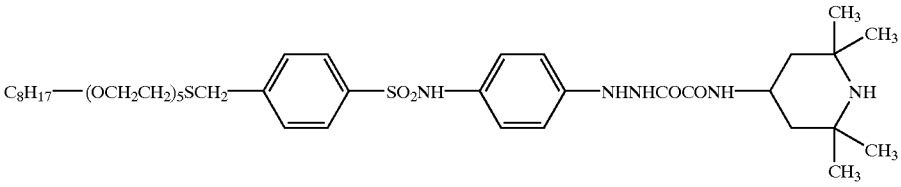
H-26
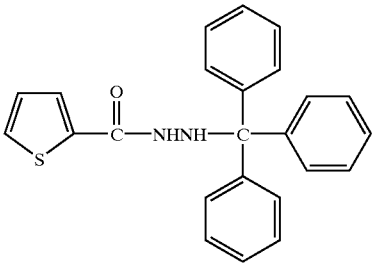
H-27
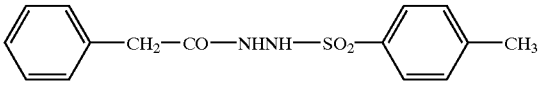
H-28
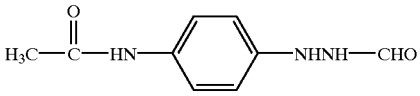
H-29
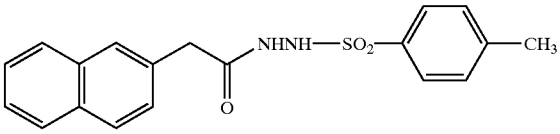
H-30
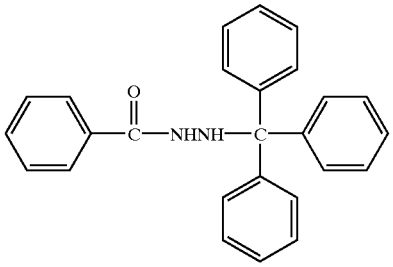

More preferred hydrazine derivatives are those which are represented by the following formulas (H-1), (H-2), (H-3), (H-4) and (H-5):

formula (H-1)

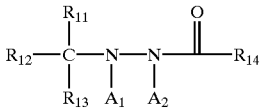

wherein $R_{11}$, $R_{12}$ and $R_{13}$ are each a substituted or unsubstituted ary group or substituted or unsubstituted heteroary group (or an aromatic heterocyclic group); $R_{14}$ is heterocyclic-oxy group or a heteroarylthio group; $A_1$ and $A_2$ are both hydrogen atoms, or one of them is a hydrogen atom and the other is an acyl group, alkylsulfonyl group or oxalyl group;

formula (H-2)

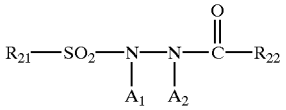

wherein $R_{21}$ is a substituted or unsubstituted alkyl group, aryl group or heteroaryl group; $R_{22}$ is a hydrogen atom, an alkylamino group, an arylamino group, or heteroarylamino group; A1 and A2 are the same as defined in formula (H-1);

formula (H-3)

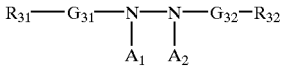

wherein $G_{31}$ and $G_{32}$ are each a —(CO)p— or —C(=S)— group, a sulfonyl group, a sulfoxy group, a —P(=O)$R_{33}$— group, or an iminomethylene group, in which p is 1 or 2, and $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group; $R_{31}$ and $R_{32}$ are each a univalent substituent group; and $A_1$ and $A_2$ are each the same as defined in formula (H-1);

formula (H-4)

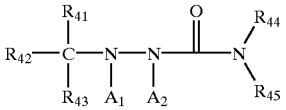

wherein $R_{41}$, $R_{42}$ and $R_{43}$ are each a substituted or unsubstituted aryl group or a substituted or unsubstituted heteroaryl group; $R_{44}$ and $R_{45}$ a substituted or unsubstituled alkyl group; and $A_1$ and $A_2$ are the same as defined in formula (H-1);

formula (H-5)

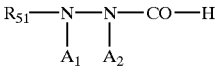

wherein $R_{51}$ is an alkyl group, an alkenyl group, an alkynyl group, an aralkyl group, a heterocyclic group, a substituted amino group, an alkylamino group, an arylamino group, heterocyclic-amino group, a hydrazine group, an alkoxy group, an aryloxy group, a heterocyclic-oxy group, an alkylthio group, an arylthio group, a heterocyclic-thio group, an alkoxycarbonyl group, an aryloxycarbonyl group, a heterocyclic-oxycarbonyl group, an alkylthiocarbonyl group, an arylthiocarbonyl group, a heterocyclic-thiocarbonyl group, a carbamoyl group, a carbamoyloxy group, a carbamoylthio group, a carbazoyl group, anoxalyl group, an alkoxyureido group, an aryloxyureido group or a heterocyclic-oxyureido group; and $A_1$ and $A_2$ are the same as defined in formula (H-1).

In formula (H-1), examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{11}$, $R_{12}$ or $R_{13}$ may combine together with each other through a linkage group. Substituents which $R_{11}$, $R_{12}$ or $R_{13}$ each may have include, for example, an alkyl group, an alkenyl group, an alkynyl group, an aryl group, a heterocyclic group, a quaternary nitrogen containing heterocyclic group (e.g., pyridionyl), hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imodo group, an amino group, a carbonamido group, a sulfonamido group, a ureido group, a thioureido group, a sulfamoylamino group, semicarbazido group, thiosemocarbaido group, hydrazine group, a quaternary ammonio group, an alkyl-, aryl- or heterocyclic-thio group, mercapto group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amido group. $A_{11}$ of $R_{11}$, $R_{12}$ and $R_{13}$ are preferably phenyl groups and more preferably unsubstituted phenyl groups.

Examples of the heteroaryl group represented by $R_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. $R_{14}$ is preferably a pyridyloxy or thenyloxy group.

Examples of the acyl group represented by $A_1$ and $A_2$ include acety, trifluoroacetyl and benzoyl; examples of the sulfonyl group include methanesulfonyl and toluenesulfonyl; and examples of the oxalyl group include ethoxalyl. $A_1$ and $A_2$ are preferably both hydrogen atoms.

In formula (H-2), examples of the alkyl group represented by $R_{21}$ include methyl, ethyl, t-butyl, 2-octyl, cyclohexyl, benzyl, and diphenylmethyl; the aryl group, the heteroaryl group and the substituent groups are the same as defined in $R_{11}$, $R_{12}$ and $R_{13}$. $R_{21}$ is preferably an aryl group or a heterocyclic group, and more preferably a phenyl group. Examples of the alkylamino group represented by $R_{22}$ include methylamino, ethylamino, propylamino, butylamino, dimethylamino diethylamino, and methylethylamino; examples of the arylamino group include anilino; and examples of the heteroaryl group include thiazolylamino, benzimidazolylamino, and benzthiazolylamino. $R_{22}$ is preferably dimethylamino or diethylamino.

In formula (H-3), the univalent substituent groups represented by $R_{31}$ and $R_{32}$ are the same as defined in formula (H-1), preferably an alkyl group, an aryl group, a heteroaryl group, an alkoxy group and an amino group, more preferably an aryl group or an alkoxy group, and specifically preferably, $R_{31}$ is phenyl and $R_{32}$ t-butoxycarbonyl. $G_{31}$ and $G_{32}$ are preferably —CO—, —COCO—, a sulfonyl group or —CS—, and are more preferably both —CO— groups or sulfonyl groups.

In formula (H-4), $R_{41}$, $R_{42}$ and $R_{43}$ are the same as defined in $R_{11}$, $R_{12}$ and $R_{13}$ of formula (H-1). $R_{41}$, $R_{42}$ and $R_{43}$ are all phenyl groups, and are more preferably all unsubstituted phenyl groups. The substituted or unsubstituted alkyl groups represented by $R_{44}$ and $R_{45}$ include, for example, methyl, ethyl, t-butyl, 2-octyl, cyclohexyl, benzyl, and diphenylmethyl, and are preferably both ethyl groups.

In formula (H-5), $R_{51}$ is the same as defined $R_{11}$, $R_{21}$, $R_{31}$ and $R_{41}$; and $A_1$ and $A_2$ are the same as defined in formula (H-1).

Exemplary examples of the compounds represented by formulas (H-1) through (H-5) are shown below, but are not limited to these.

H-1-1

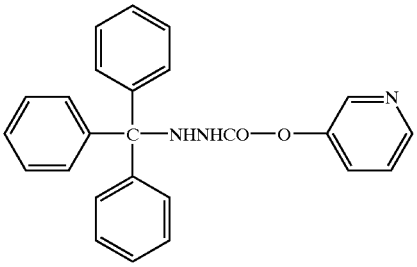

H-1-2

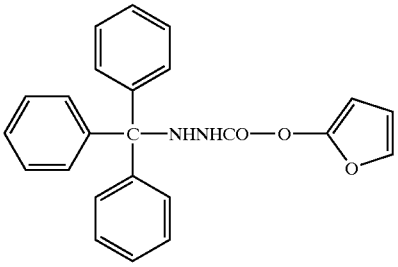

H-1-3

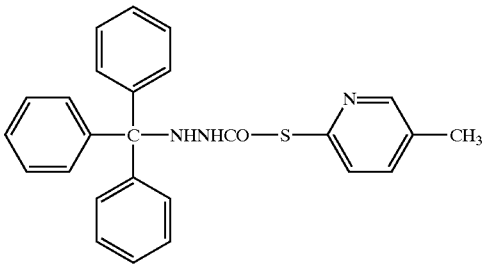

H-1-4

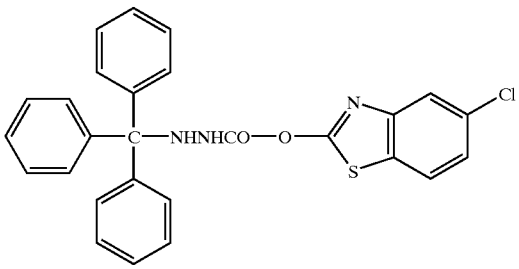

-continued

H-1-5

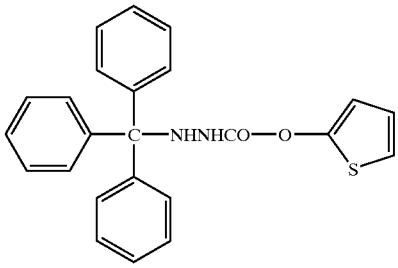

H-1-6

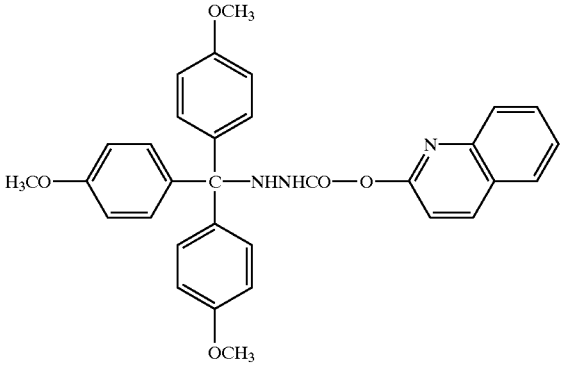

H-1-7

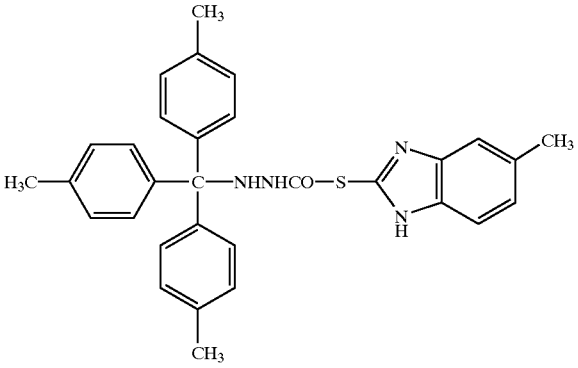

H-1-8

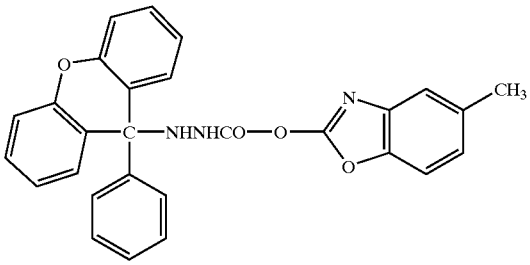

H-1-9

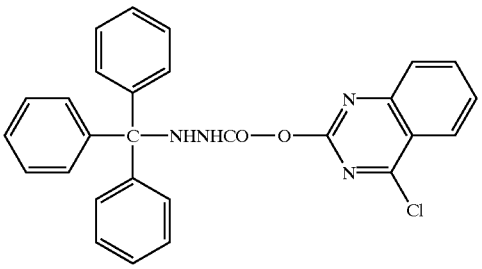

-continued
H-1-10
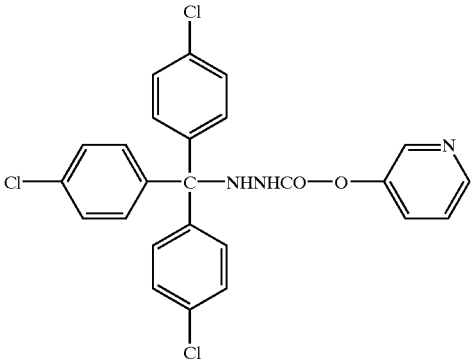
H-1-11
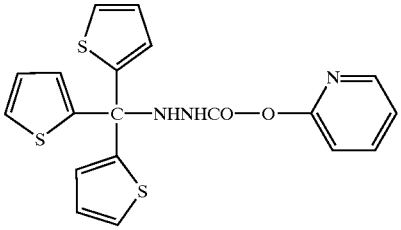
H-1-12
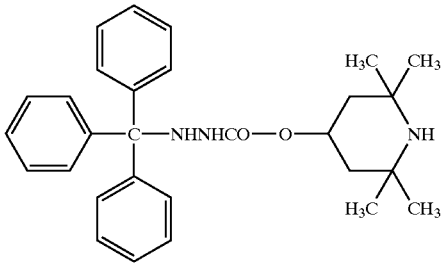
H-2-1
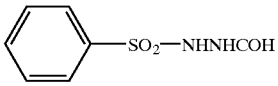
H-2-2
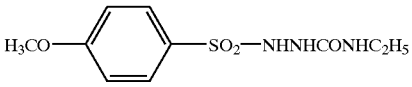
H-2-3
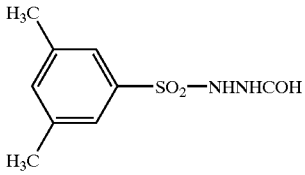
H-2-4
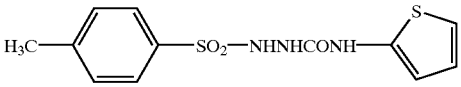
H-2-5
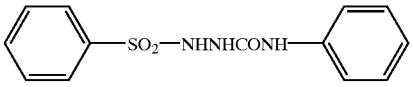
H-2-6
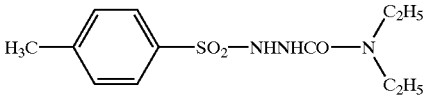
H-2-7
-continued
H-2-8
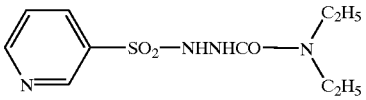
H-2-9
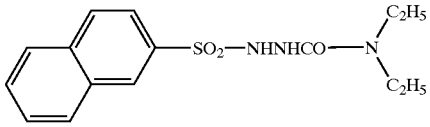
H-3-1
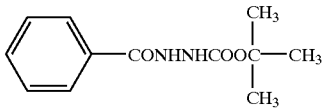
H-3-2
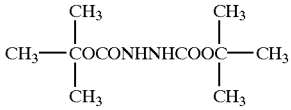
H-3-3
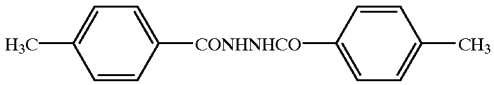
H-3-4
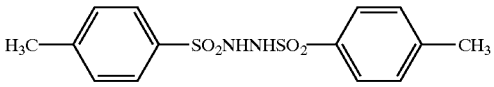
H-3-5
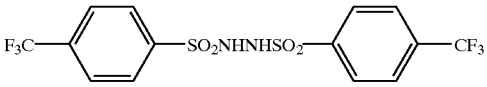
H-3-6
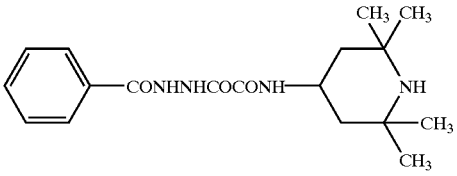
H-3-7
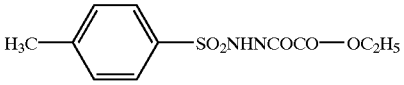
H-3-8
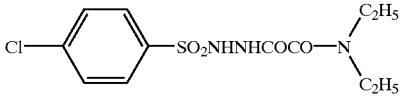
H-3-9
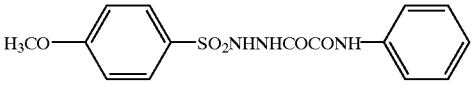
H-3-10
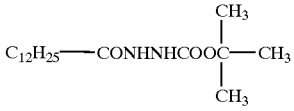
H-3-11
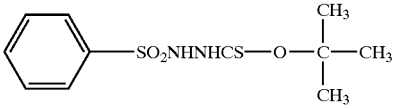

-continued
H-3-12
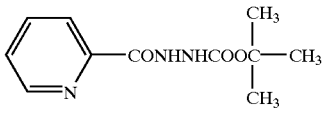
H-4-1
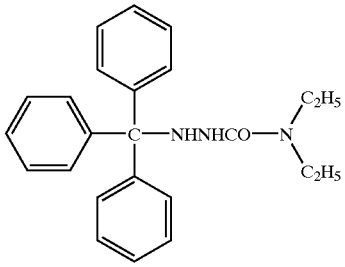
H-4-2
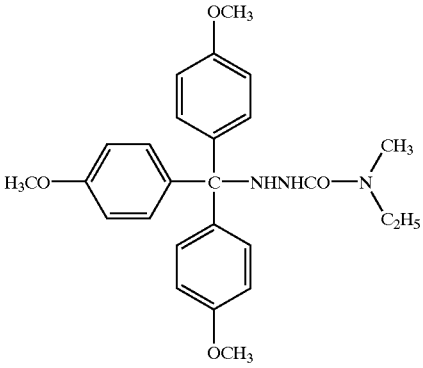
H-4-3
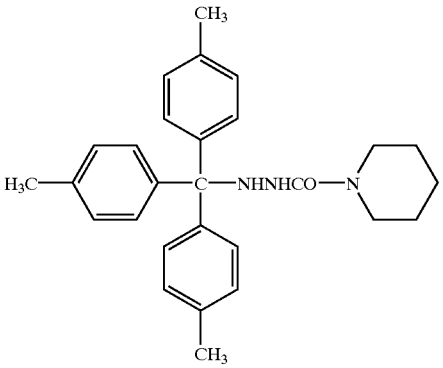
H-4-4
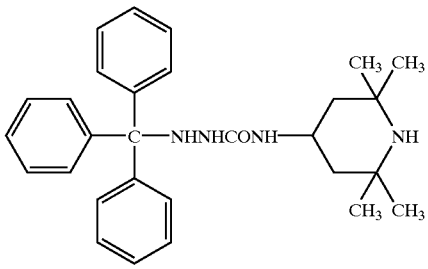
-continued
H-4-5
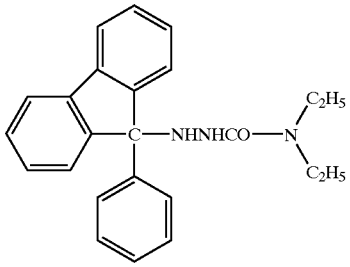
H-5-1
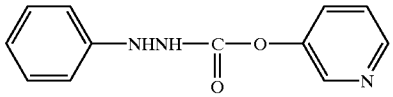
H-5-2
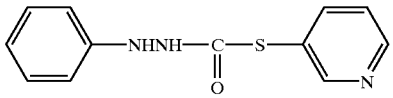
H-5-3
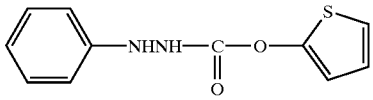
H-5-4
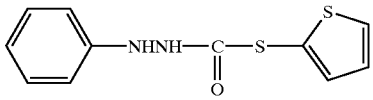
H-5-5
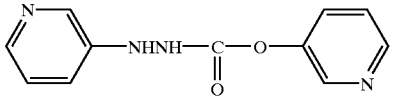
H-5-6
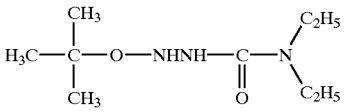
H-5-7
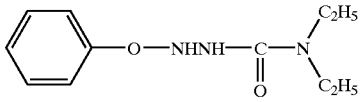
H-5-8
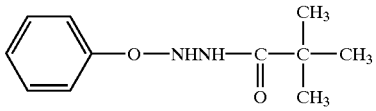
H-5-9
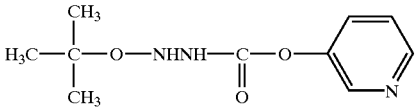
H-5-10
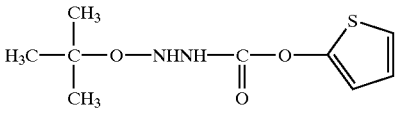
H-5-11
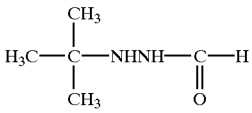

-continued

H-5-12

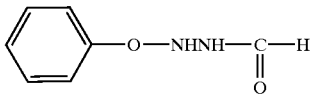

H-5-13

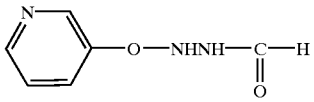

H-5-14

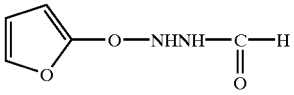

H-5-15

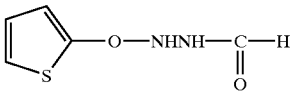

H-5-16

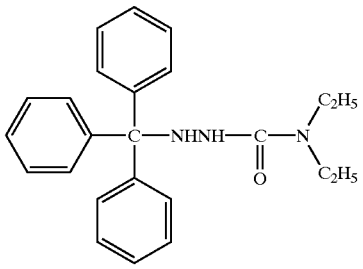

H-5-17

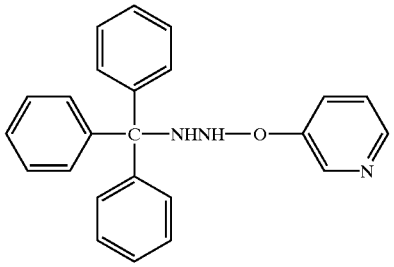

H-5-18

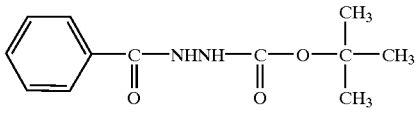

H-5-19

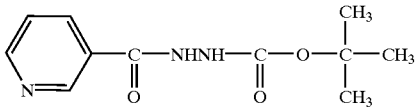

H-5-20

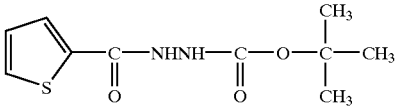

H-5-21

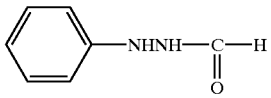

-continued

H-5-22

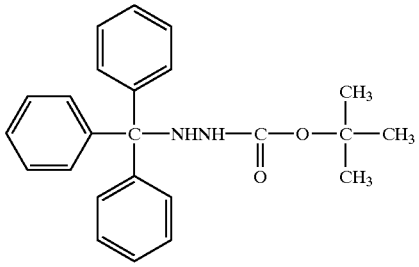

H-5-23

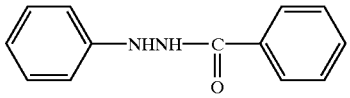

H-5-24

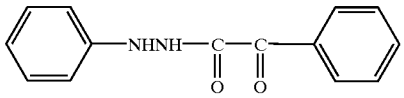

H-5-25

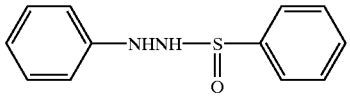

H-5-26

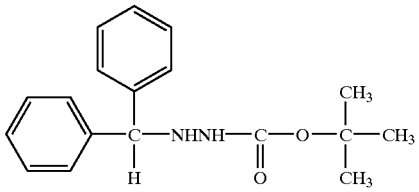

H-5-27

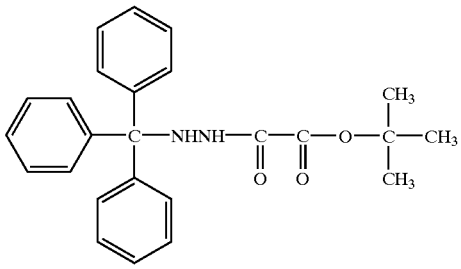

H-5-28

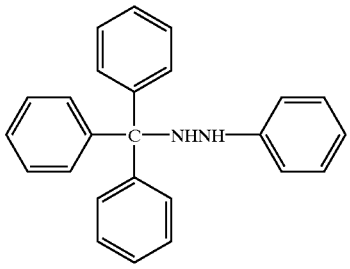

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

The hydrazine derivative is incorporated into a photosensitive layer containing a silver halide emulsion and/or a layer adjacent thereto. The amount to be incorporated, depending of a silver halide grain size, halide composition, a degree of chemical sensitization and the kind of an antifoggant, is preferably $10^{-6}$ to $10^{-1}$, and more preferably $10^{-5}$ to $10^{-2}$ mole per mole of silver halide.

The quaternary onium compound is preferably a compound represented by formula (P):

formula (P)

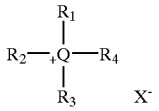

wherein Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

Further, quaternary onium salt compounds usable in this invention include compounds represented by formulas (Pa), (Pb) and (Pc), or formula (T):

formula (Pa)

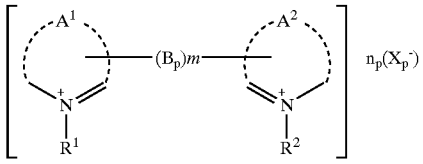

formula (Pb)

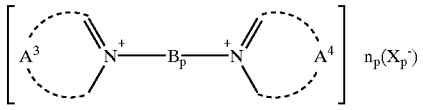

formula (Pc)

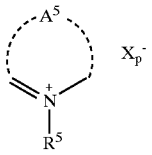

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

formula (T)

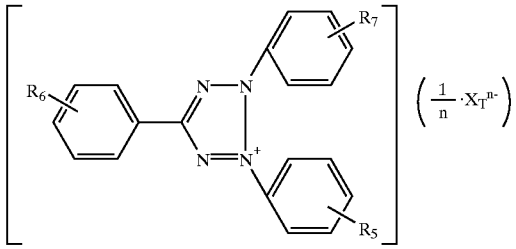

Substituent groups $R_5$, $R_6$ and $R_7$, substituted on the phenyl group are preferably a hydrogen atom or a group, of which Hammett's σ-value exhibiting a degree of electron attractiveness is negative.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative devalues include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X_T^{n-}$ n for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonric anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

Exemplary examples of the quaternary onium compounds are shown below, but are not limited to these.

P-1

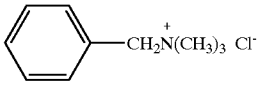

P-2

$C_{16}H_{33}\overset{+}{N}(CH_3)_3\ Br^-$

P-3

$\overset{+}{N}(C_4H_9)_4\ Cl^-$

P-4

$(CH_3)_3\overset{+}{N}CH_2CH_2OH\ Cl^-$

P-5

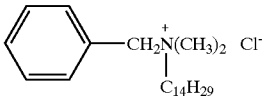

P-6

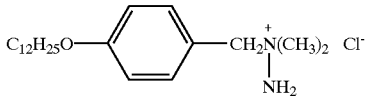

P-7

$(C_2H_5)_2\overset{+}{N}(CH_2)_4\overset{+}{N}(C_2H_5)_2\ 2Cl^-$ ($NH_2$ on each N)

P-8

$(C_4H_9)_3\overset{+}{N}CH_2CH_2\overset{+}{N}(C_4H_9)_3\ SO_4^{2-}$

P-9

$(C_2H_5)_3\overset{+}{N}(CH_2)_8\overset{+}{N}(C_2H_5)_3\ 2Cl^-$

P-10

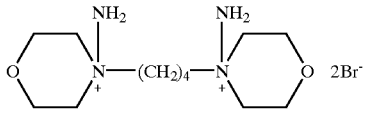

P-11

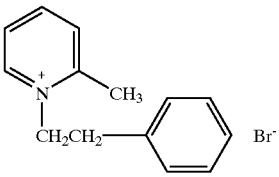

P-12

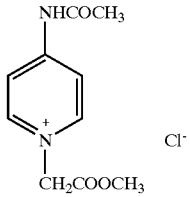

P-13

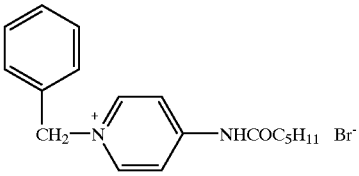

P-14

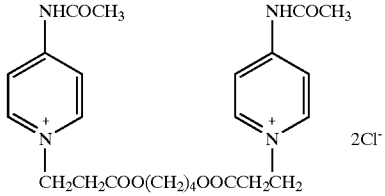

P-15

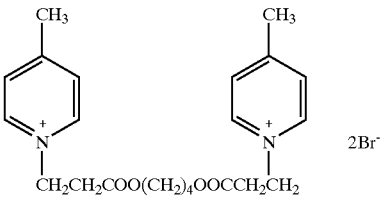

P-16

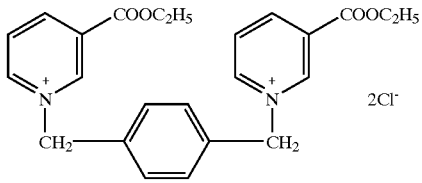

P-17

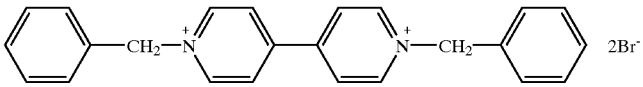

P-18

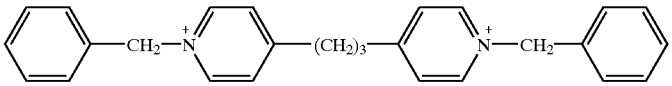

-continued
P-19
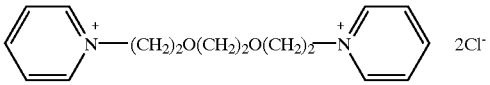
P-20
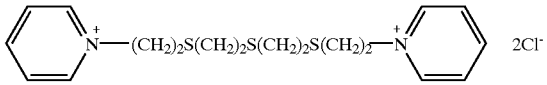
P-21
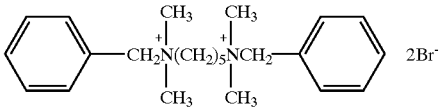
P-22
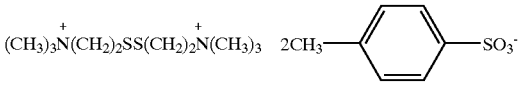
P-23
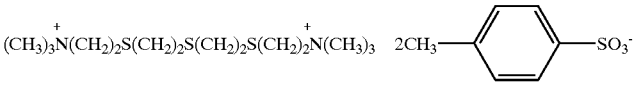
P-24
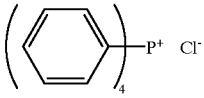
P-25
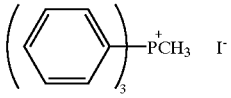
P-26
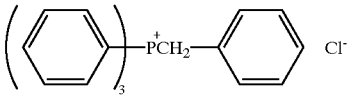
P-27
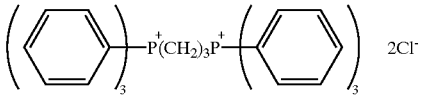
P-28
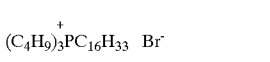
P-29
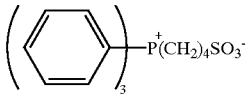
P-30
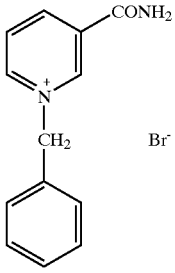
P-31
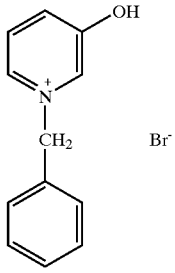
P-32
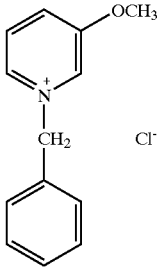
P-33
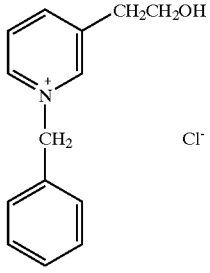
P-34
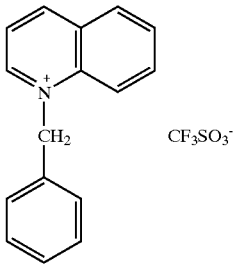
P-35
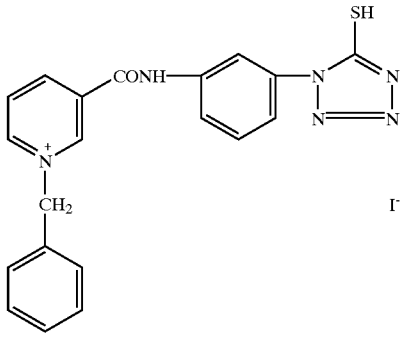

-continued
P-36
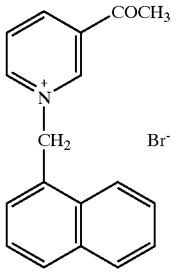
P-37
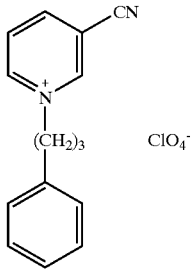
P-38
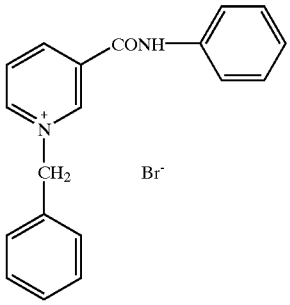
P-39
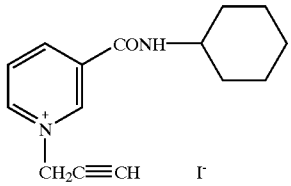
P-40
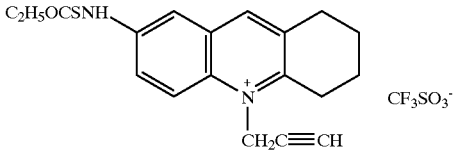
P-41
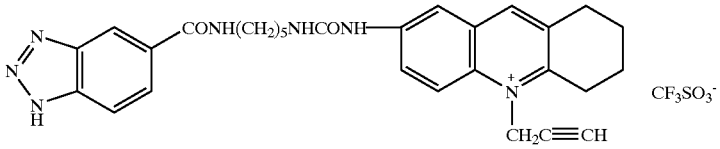
P-42
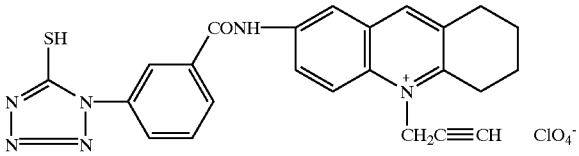
P-43
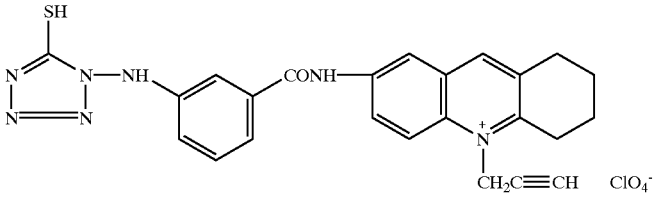
P-44
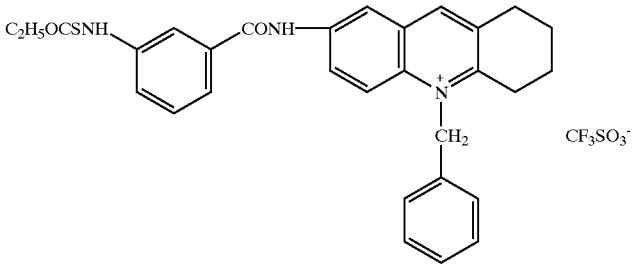

-continued
P-45
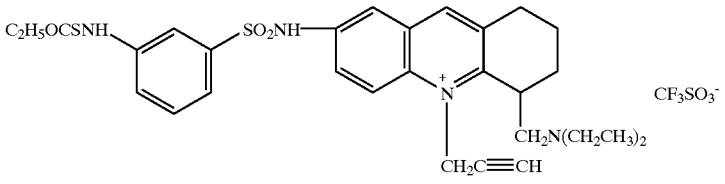
P-46
P-47
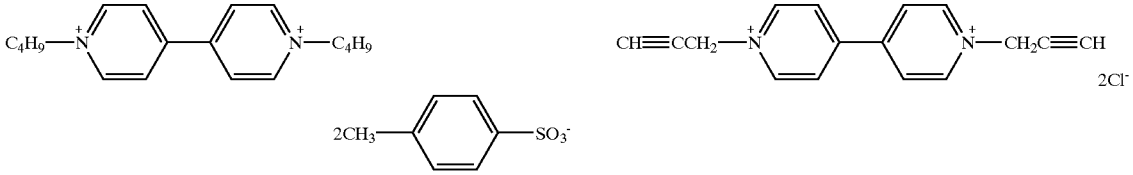
P-48
P-49
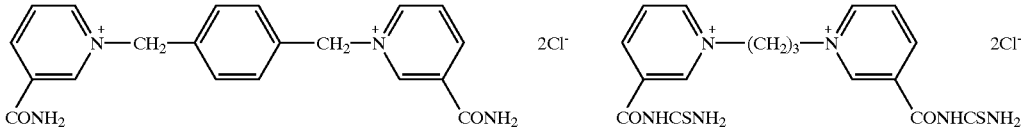
P-50
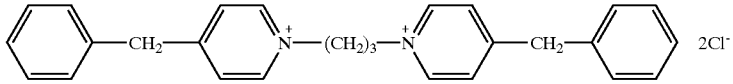
P-51
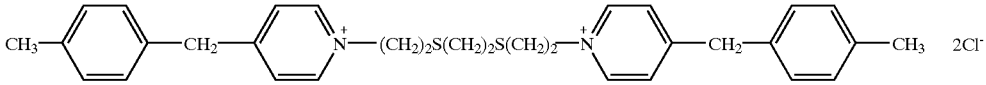
P-52
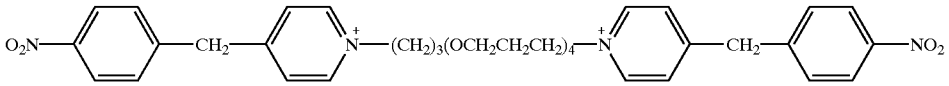
P-53
P-54
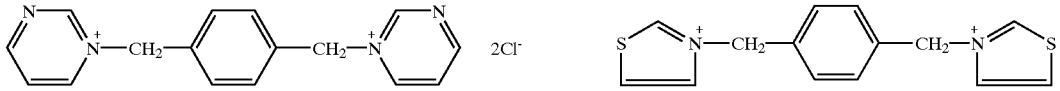
P-55
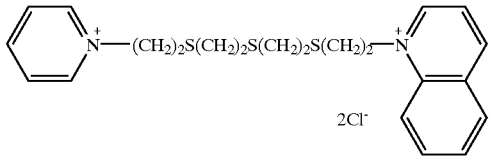
-continued
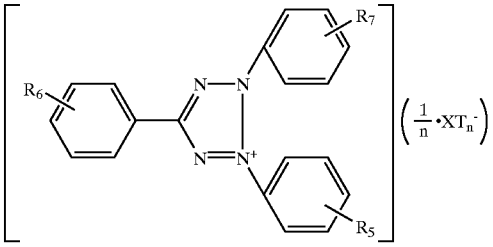
| Compd. No. | $R_5$ | $R_6$ | $R_7$ | $X_T^{n-}$ |
|---|---|---|---|---|
| T-1 | H | H | p-$CH_3$ | — |
| T-2 | p-$CH_3$ | H | p-$CH_3$ | $Cl^-$ |
-continued
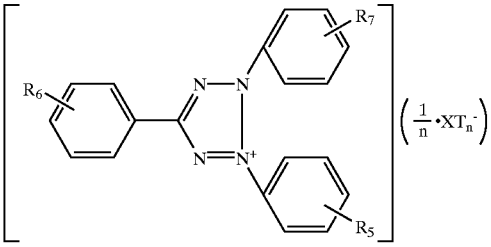
| Compd. No. | $R_5$ | $R_6$ | $R_7$ | $X_T^{n-}$ |
|---|---|---|---|---|
| T-3 | p-$CH_3$ | p-$CH_3$ | p-$CH_3$ | $Cl^-$ |
| T-4 | H | p-$CH_3$ | p-$CH_3$ | $Cl^-$ |

-continued

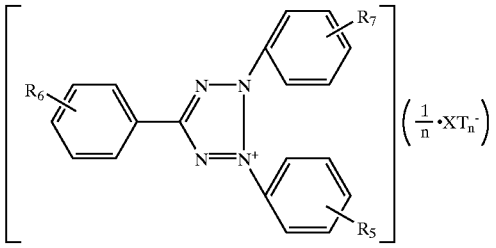

| Compd. No. | $R_5$ | $R_6$ | $R_7$ | $X_T^{n-}$ |
|---|---|---|---|---|
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The quaternary onium salt compounds described above can be readily synthesized according to the methods commonly known in the art. For example, the tetrazolium compounds described above may be referred to Chemical Review 55, page 335–483.

The quaternary onium compound is incorporated preferably in an amount of $1\times10^{-8}$ to 1 mole, and $1\times10^{-7}$ to $1\times10^{-1}$ mole per mole of silver halide, which may be incorporated to a photothermographic material at any time from during silver halide grain formation and to coating.

Vinyl type compounds usable as a contrast-increasing agent in photothermographic materials used in this invention will be described below:

formula (A)

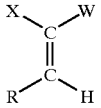

In formula (A), X and R are represented as a cis form, but X and R in a trans-form are also included in the formula (A). This is the same in exemplary compounds described later.

In the formula, X is an electron-with drawing group; W is a hydrogen atom, an alkyl group, alkenyl group, an ellkynyl group, an aryl group, a heterocyclic group, a halogen atom, an acyl group, a thioacyl group, an oxalyl group, an oxyaxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino grou, a N-carbonylimino group, a N-sulfonylimino group, a dicyanoethylene group, an ammonium group, a sulfoniumr group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the rinf formed by X and W include pyrazolone, pyrazolidinone, cyclopentadione, β-ketolactone, and β-ketolactam.

In formula (A), the electron-withdrawing group refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl cjroup (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinzmoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium grou, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

Exemplary examples of the compounds represented by formula (A) are shown below, but are not limited to these.

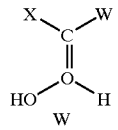

| X | —$COCH_3$ | —$COCF_3$ | —CO— 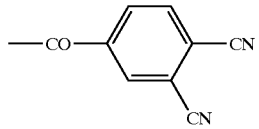 | —CHO | —$COCH_2SCH_3$ |
|---|---|---|---|---|---|
| —$COOC_2H_5$ | 1-1 | 2-1 | 3-1 | 4-1 | 5-1 |
| —$COCOOC_2H_5$ | 1-2 | 2-2 | 3-2 | 4-2 | 5-2 |
| —$COCF_3$ | 1-3 | 2-3 | 3-3 | 4-3 | 5-3 |
| —$SO_2CH_3$ | 1-4 | 2-4 | 3-4 | 4-4 | 5-4 |
| —CHO | 1-5 | — | 3-5 | 4-5 | 5-5 |
| —$COCH_3$ | 1-6 | — | 3-6 | — | 5-6 |
| —$COCH_2SCH_3$ | — | — | 3-7 | — | 5-7 |
| —$SO_2CF_3$ | 1-7 | 2-5 | 3-8 | 4-6 | 5-8 |
| 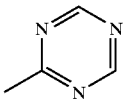 | 1-8 | 2-6 | 3-9 | 4-7 | 5-9 |
| —$COOC_2H_4SCH_3$ | 1-9 | 2-7 | 3-10 | 4-8 | 5-10 |
| —$COCOOC_2H_4SCH_3$ | 1-10 | 2-8 | 3-11 | 4-9 | 5-11 |
| —$COCONHC_2H_4SCH_3$ | 1-11 | 2-9 | 3-12 | 4-10 | 5-12 |

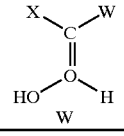

| X | —$COCOCH_3$ | —$COCOOC_2H_5$ | —$COCOSC_2H_5$ |
|---|---|---|---|
| —$COOC_2H_5$ | 6-1 | 7-1 | 8-1 |
| —$COCOOC_2H_5$ | 6-2 | 7-2 | 8-2 |
| —$COCH_3$ | 6-3 | — | 8-3 |
| —$COCF_3$ | 6-4 | — | 8-4 |
| —$SO_2CH_3$ | 6-5 | 7-3 | 8-5 |
| —$SO_2CF_3$ | 6-6 | 7-4 | 8-6 |
| —CHO | 6-7 | — | 8-7 |
| —$COCH_2SCH_3$ | 6-8 | — | 8-8 |
| 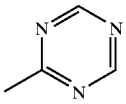 | 6-9 | 7-5 | 8-9 |
| —$COOC_2H_4SCH_3$ | 6-10 | 7-6 | 8-10 |
| —$COCOOC_2H_4SCH_3$ | 6-11 | 7-7 | 8-11 |
| —$COCONHC_2H_4SCH_3$ | 6-12 | 7-8 | 8-12 |

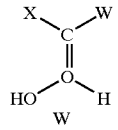

| X | —$COCONHC_2H_4SCH_3$ | —C(=S)—$CH_3$ | —$COOC_2H_5$ | —$COSC_2H_5$ |
|---|---|---|---|---|
| —$COOC_2H_5$ | 9-1 | 10-1 | 11-1 | 12-1 |
| —$COCOOC_2H_5$ | 9-2 | 10-2 | — | 12-2 |
| —$COCH_3$ | — | 10-3 | — | 12-3 |
| —$COCF_3$ | — | 10-4 | — | 12-4 |
| —$SO_2CH_3$ | 9-3 | 10-5 | 11-2 | 12-5 |
| —$SO_2CF_3$ | 9-4 | 10-6 | 11-3 | 12-6 |

-continued
| | | | | |
|---|---|---|---|---|
| —CHO | — | 10-7 | — | 12-7 |
| —$COCH_2SCH_3$ | — | 10-8 | — | 12-8 |
| 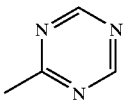 | 9-5 | 10-9 | 11-4 | 12-9 |
| —$COOC_2H_4SCH_3$ | 9-6 | 10-10 | 11-5 | 12-10 |
| —$COCOOC_2H_4SCH_3$ | 9-7 | 10-11 | 11-6 | 12-11 |
| —$COCONHC_2H_4SCH_3$ | 9-8 | 10-12 | — | 12-12 |
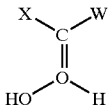
| X | 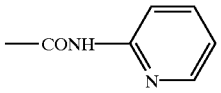 | 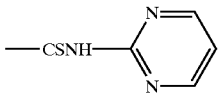 | —$SO_2CH_3$ |
|---|---|---|---|
| —$COOC_2H_5$ | 13-1 | 14-1 | 15-1 |
| —$COCOOC_2H_5$ | 13-2 | 14-2 | 15-2 |
| —$COCH_3$ | 13-3 | 14-3 | — |
| —$COCF_3$ | 13-4 | 14-4 | — |
| —$SO_2CH_3$ | 13-5 | 14-5 | 15-3 |
| —$SO_2CF_3$ | 13-6 | 14-6 | 15-4 |
| —CHO | 13-7 | 14-7 | — |
| —$COCH_2SCH_3$ | 13-8 | 14-8 | — |
| 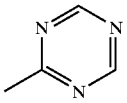 | 13-9 | 14-9 | 15-5 |
| —$COOC_2H_4SCH_3$ | 13-10 | 14-10 | 15-6 |
| —$COCOOC_2H_4SCH_3$ | 13-11 | 14-11 | 15-7 |
| —$COCONHC_2H_4SCH_3$ | 13-12 | 14-12 | 15-8 |
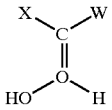
| X | —$SO_2CF_3$ | —$SOCH_3$ | —$SO_2OCH_3$ | —$SO_2SCH_3$ | —$SO_2NH_2$ |
|---|---|---|---|---|---|
| —$COOC_2H_5$ | — | 17-1 | 18-1 | 19-1 | 20-1 |
| —$COCOOC_2H_5$ | — | 17-2 | 18-2 | 19-2 | 20-2 |
| —$COCH_3$ | — | 17-3 | 18-3 | 19-3 | 20-3 |
| —$COCF_3$ | — | 17-4 | 18-4 | 19-4 | 20-4 |
| —$SO_2CH_3$ | — | 17-5 | 18-5 | 19-5 | 20-5 |
| —$SO_2CF_3$ | — | 17-6 | 18-6 | 19-6 | 20-6 |
| —CHO | — | 17-7 | 18-7 | 19-7 | 20-7 |
| —$COCH_2SCH_3$ | — | 17-8 | 18-8 | 19-8 | 20-8 |
| 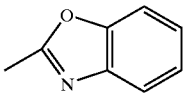 | 16-1 | 17-9 | 18-9 | 19-9 | 20-9 |
| —$COOC_2H_4SCH_3$ | — | 17-10 | 18-10 | 19-10 | 20-10 |
| —$COCOOC_2H_4SCH_3$ | — | 17-11 | 18-11 | 19-11 | 20-11 |
| —$COCONHC_2H_4SCH_3$ | 16-2 | 17-12 | 18-12 | 19-12 | 20-12 |

-continued
| X | 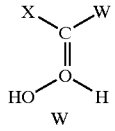 | | | | |
|---|---|---|---|---|---|
| | 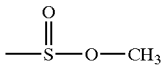 | 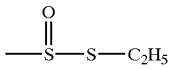 | 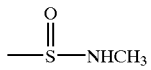 | 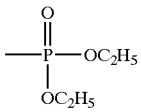 | —$NO_2$ |
| —$COOC_2F_4H$ | 21-1 | 22-1 | 23-1 | 24-1 | 25-1 |
| —$COCOOCH_2C_2F_4H$ | 21-2 | 22-2 | 23-2 | 24-2 | 25-2 |
| —$COCH_3$ | 21-3 | 22-3 | 23-3 | 24-3 | 25-3 |
| —$COCF_3$ | 21-4 | 22-4 | 23-4 | 24-4 | 25-4 |
| —$SO_2CH_3$ | 21-5 | 22-5 | 23-5 | 24-5 | 25-5 |
| —$SO_2CF_3$ | 21-6 | 22-6 | 23-6 | 24-6 | 25-6 |
| —CHO | 21-7 | 22-7 | 23-7 | 24-7 | 25-7 |
| —$COCH_2SCH_3$ | 21-8 | 22-8 | 23-8 | 24-8 | 25-8 |
| 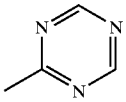 | 21-9 | 22-9 | 23-9 | 24-9 | 25-9 |
| —$COOC_2H_4SCH_3$ | 21-10 | 22-10 | 23-10 | 24-10 | 25-10 |
| —$COCOOC_2H_4SCH_3$ | 21-11 | 22-11 | 23-11 | 24-11 | 25-11 |
| —$COCONHC_2H_4SCH_3$ | 21-12 | 22-12 | 23-12 | 24-12 | 25-12 |
| X | 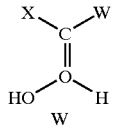 | | | | |
|---|---|---|---|---|---|
| | 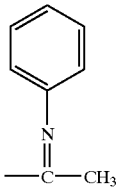 | 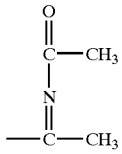 | 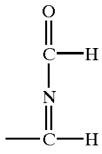 | 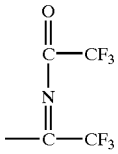 | 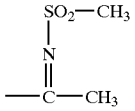 |
| —$COOC_2H_5$ | 28-1 | 27-1 | 28-1 | 29-1 | 30-1 |
| —$COCOOC_2H_5$ | 26-2 | 27-2 | 28-2 | 29-2 | 30-2 |
| —$COCH_3$ | 26-3 | 27-3 | 28-3 | 29-3 | 30-3 |
| —$COCF_3$ | 26-4 | 27-4 | 28-4 | 29-4 | 30-4 |
| —$SO_2CH_3$ | 26-5 | 27-5 | 28-5 | 29-5 | 30-5 |
| —$SO_2CF_3$ | 26-6 | 27-6 | 28-6 | 29-6 | 30-6 |
| —CHO | 26-7 | 27-7 | 28-7 | 29-7 | 30-7 |
| 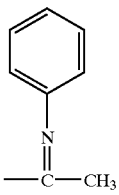 | 26-8 | 27-8 | 28-8 | 29-8 | 30-8 |
| 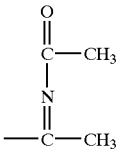 | — | 27-9 | 28-9 | 29-9 | 30-9 |

-continued
| | | | | | |
|---|---|---|---|---|---|
| 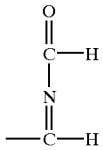 | — | — | 28-10 | 29-10 | 30-10 |
| 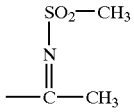 | — | — | — | 29-11 | 30-11 |
| X | 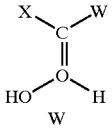 | | | | |
|---|---|---|---|---|---|
| | 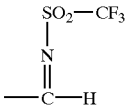 | 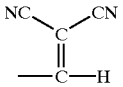 | 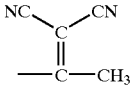 | 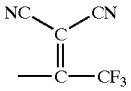 | 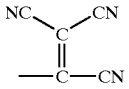 |
| —$COOC_2H_5$ | 31-1 | 32-1 | 33-1 | 34-1 | 35-1 |
| —$COCOOC_2H_5$ | 31-2 | 32-2 | 33-2 | 34-2 | 35-2 |
| —$COCH_3$ | 31-3 | 32-3 | 33-3 | 34-3 | 35-3 |
| —$COCF_3$ | 31-4 | 32-4 | 33-4 | 34-4 | 35-4 |
| —CHO | 31-5 | 32-5 | 33-5 | 34-5 | 35-5 |
| —$SO_2CH_3$ | 31-6 | 32-6 | 33-6 | 34-6 | 35-6 |
| —$SO_2CF_3$ | 31-7 | 32-7 | 33-7 | 34-7 | 35-7 |
| 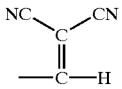 | 31-8 | 32-8 | 33-8 | 34-8 | 35-8 |
| 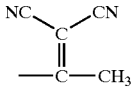 | 31-9 | — | 33-9 | 34-9 | 35-9 |
| 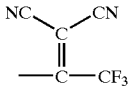 | 31-10 | — | — | 34-10 | 35-10 |
| 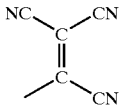 | 31-11 | — | — | — | 35-11 |
| X | 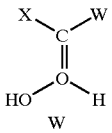 | | | | |
|---|---|---|---|---|---|
| | —$CF_3$ | —CH═CH—CN | —CH═CH—CHO | —C≡C—$CF_3$ | —C≡C—CN |
| —$COOC_2H_5$ | 36-1 | 37-1 | 38-1 | 39-1 | 40-1 |
| —$COCOOC_2H_5$ | 36-2 | 37-2 | 38-2 | 39-2 | 40-2 |
| —$COCF_3$ | 36-3 | 37-3 | 38-3 | 39-3 | 40-3 |
| —$SO_2CH_3$ | 36-4 | 37-4 | 38-4 | 39-4 | 40-4 |
| —$COCH_3$ | 36-5 | 37-5 | 38-5 | 39-5 | 40-5 |
| —$SO_2CF_3$ | 36-6 | 37-6 | 38-6 | 39-6 | 40-6 |
| —CHO | 36-7 | 37-7 | 38-7 | 39-7 | 40-7 |
| —$COCH_2SCH_3$ | 36-8 | 37-8 | 38-8 | 39-8 | 40-8 |

-continued
| | | | | | |
|---|---|---|---|---|---|
| 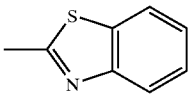 | 36-9 | 37-9 | 38-9 | 39-9 | 40-9 |
| —$COOC_2H_4SCH_3$ | 36-10 | 37-10 | 38-10 | 39-10 | 40-10 |
| —$COCOOC_2H_4SCH_3$ | 36-11 | 37-11 | 38-11 | 39-11 | 40-11 |
| —$COCONHC_2H_4SCH_3$ | 36-12 | 37-12 | 38-12 | 39-12 | 40-12 |
| | 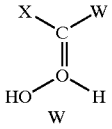 | | | | |
|---|---|---|---|---|---|
| X | 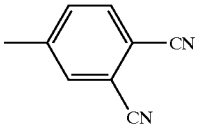 | 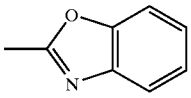 | 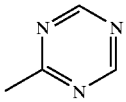 | Cl | H |
| —$COOC_2H_5$ | 41-1 | 42-1 | 43-1 | 44-1 | 45-1 |
| —$COCOOC_2H_5$ | 41-2 | 42-2 | 43-2 | 44-2 | 45-2 |
| —$COCH_3$ | 41-3 | 42-3 | — | 44-3 | 45-3 |
| —$COCF_3$ | 41-4 | 42-4 | — | 44-4 | 45-4 |
| —$SO_2CH_3$ | 41-5 | 42-5 | 43-3 | 44-5 | 45-5 |
| —$SO_2CF_3$ | 41-6 | — | 43-4 | 44-6 | 45-6 |
| —CHO | 41-7 | 42-6 | — | 44-7 | 45-7 |
| —$COCH_2SCH_3$ | 41-8 | 42-7 | — | 44-8 | 45-8 |
| 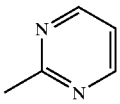 | 41-9 | 42-8 | 43-5 | 44-9 | 45-9 |
| —$COOC_2H_4SCH_3$ | 41-10 | 42-9 | 43-6 | 44-10 | 45-10 |
| —$COCOOC_2H_4SCH_3$ | 41-11 | 42-10 | 43-7 | 44-11 | 45-11 |
| —$COCONHC_2H_4SCH_3$ | 41-12 | 42-11 | 43-8 | 44-12 | 45-12 |
| | 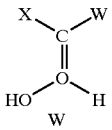 | |
|---|---|---|
| X | 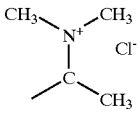 | 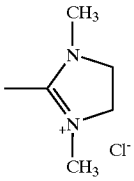 |
| —$COOC_2H_5$ | 51-1 | 52-1 |
| —$COCOOC_2H_5$ | 51-2 | 52-2 |
| —$COCH_3$ | 51-3 | 52-3 |
| —$COCCl_3$ | 51-4 | 52-4 |
| —$SO_2CH_3$ | 51-5 | 52-5 |
| —$SO_2CF_3$ | 51-6 | 52-6 |
| —CHO | 51-7 | 52-7 |
| 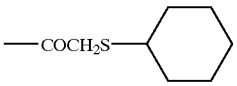 | 51-8 | 52-8 |
| 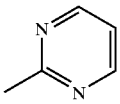 | 51-9 | 52-9 |

-continued
| | | |
|---|---|---|
| —$COOC_2H_4SC_2H_5$ | 51-10 | 52-10 |
| —$COCOOC_2H_4SC_2H_5$ | 51-11 | 52-11 |
| —$COCONHC_2H_4S$— 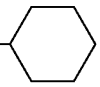 | 51-12 | 52-12 |
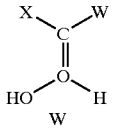
| X | 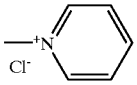 | 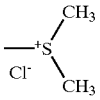 | 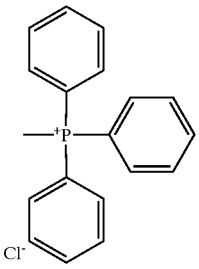 | 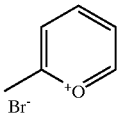 | 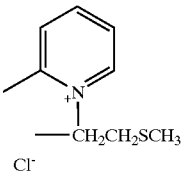 |
|---|---|---|---|---|---|
| —$COOC_2H_5$ | 46-1 | 47-1 | 48-1 | 49-1 | 50-1 |
| —$COCOOC_2H_5$ | 46-2 | 47-2 | 48-2 | 49-2 | 50-2 |
| —$COCH_3$ | 46-3 | 47-3 | 48-3 | 49-3 | 50-3 |
| —$COCF_3$ | 46-4 | 47-4 | 48-4 | 49-4 | 50-4 |
| —$SO_2CH_3$ | 46-5 | 47-5 | 48-5 | 49-5 | 50-5 |
| —$SO_2CF_3$ | 46-6 | 47-6 | 48-6 | 49-6 | 50-6 |
| —CHO | 46-7 | 47-7 | 48-7 | 49-7 | 50-7 |
| —$COCH_2SCH_3$ | 46-8 | 47-8 | 48-8 | 49-8 | 50-8 |
| 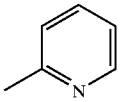 | 46-9 | 47-9 | 48-9 | 49-9 | 50-9 |
| —$COOC_2H_4SCH_3$ | 46-10 | 47-10 | 48-10 | 49-10 | 50-10 |
| —$COCOOC_2H_4SCH_3$ | 46-11 | 47-11 | 48-11 | 49-11 | 50-11 |
| —$COCONHC_2H_4SCH_3$ | 46-12 | 47-12 | 48-12 | 49-12 | 50-12 |
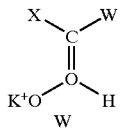
| X | —$COCH_3$ | —$COCF_3$ | —CHO | —$COCH_2SCH_3$ | —$SO_2CH_3$ |
|---|---|---|---|---|---|
| —$COOC_2H_5$ | 53-1 | 54-1 | 55-1 | 56-1 | 57-1 |
| —$COCOOC_2H_5$ | 53-2 | 54-2 | 55-2 | 56-2 | 57-2 |
| —$COCH_3$ | 53-3 | 54-3 | 55-3 | 56-3 | 57-3 |
| —$COCF_3$ | — | 54-4 | 55-4 | 56-4 | 57-4 |
| —CHO | — | — | 55-5 | 56-5 | 57-5 |
| —$SO_2CH_3$ | — | — | — | 56-6 | 57-6 |
| —$SO_2CF_3$ | 53-4 | 54-5 | 55-6 | 56-7 | 57-7 |
| —$COCH_2SCH_3$ | — | — | — | 56-8 | — |
| 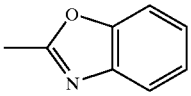 | 53-5 | 54-6 | 55-7 | 56-9 | 57-8 |
| —$COOC_2H_4SCH_3$ | 53-6 | 54-7 | 55-8 | 56-10 | 57-9 |
| —$COCOOC_2H_4SCH_3$ | 53-7 | 54-8 | 55-9 | 56-11 | 57-10 |
| —$COCONHC_2H_4SCH_3$ | 53-8 | 54-9 | 55-10 | 56-12 | 57-11 |

-continued
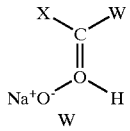
| X | —$SO_2CF_3$ | 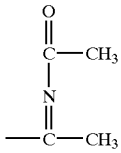 | 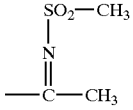 | 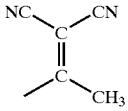 | 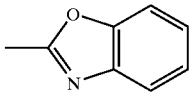 |
|---|---|---|---|---|---|
| —$COOC_2H_5$ | 58-1 | 59-1 | 60-1 | 61-1 | 62-1 |
| —$COCOOC_2H_5$ | 58-2 | 59-2 | 60-2 | 61-2 | 62-2 |
| —$COCH_3$ | — | 59-3 | 60-3 | 61-3 | — |
| —$COCF_3$ | — | 59-4 | 60-4 | 61-4 | — |
| —CHO | — | 59-5 | 60-5 | 61-5 | — |
| —$SO_2CH_3$ | — | 59-6 | 60-6 | 61-6 | — |
| —$SO_2CF_3$ | 58-3 | 59-7 | 60-7 | 61-7 | 62-3 |
| —$COCH_2SCH_3$ | 58-4 | 59-8 | 60-8 | 61-8 | — |
| 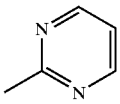 | 58-5 | 59-9 | 60-9 | 61-9 | 62-4 |
| —$COOC_2H_4SCH_3$ | 58-6 | 59-10 | 60-10 | 61-10 | 62-5 |
| —$COCOOC_2H_4SCH_3$ | 58-7 | 59-11 | 60-11 | 61-11 | 62-6 |
| —$COCONHC_2H_4SCH_3$ | 58-8 | 59-12 | 60-12 | 61-12 | 62-7 |
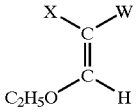
| X | —$COCCl_3$ | —$COC_2F_4H$ | —CHO | —$COCH_2SCH_3$ |
|---|---|---|---|---|
| —$COOC_2H_4SCH_3$ | 63-1 | 64-1 | 65-1 | 66-1 |
| —$COCOOC_2H_4SCH_3$ | 63-2 | 64-2 | 65-2 | 66-2 |
| —$COCF_3$ | 63-3 | 64-3 | 65-3 | 66-3 |
| —CHO | 63-4 | 64-4 | 65-4 | 66-4 |
| —$SO_2CH_3$ | 63-5 | 64-5 | 65-5 | 66-5 |
| —$SO_2CF_3$ | 63-6 | 64-6 | 65-6 | 66-6 |
| —$COCH_2SCH_3$ | 63-7 | 64-7 | 65-7 | 66-7 |
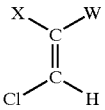
| X | —$COCF_3$ | —CHO | —$COCH_2SCH_3$ | 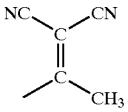 | 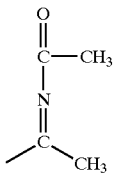 | 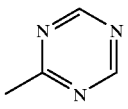 |
|---|---|---|---|---|---|---|
| —$COOC_2H_5$ | 67-1 | 67-2 | — | 67-4 | 67-6 | — |
| —$COCH_2SCH_3$ | — | — | 67-3 | — | — | — |
| —$COCH_3$ | — | — | — | — | — | 67-5 |

-continued
68-1
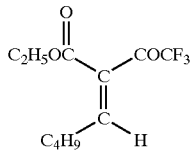
68-2
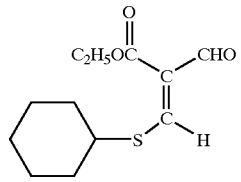
68-3
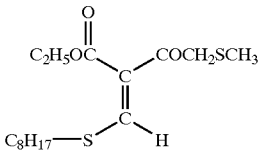
68-4
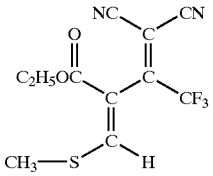
68-5
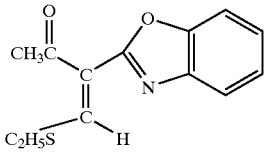
68-6
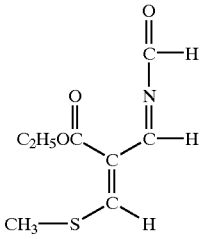
69-1
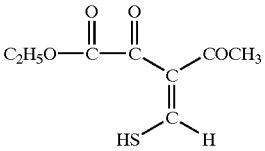
69-2
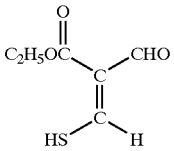
70-1
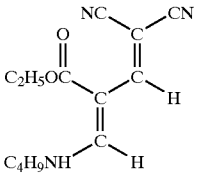
71-1
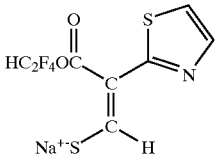
71-2
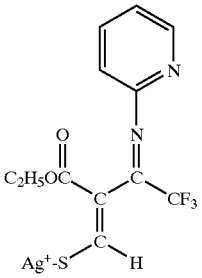
71-3
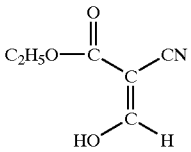
71-4
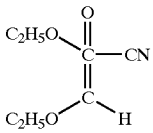
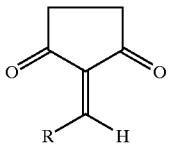
| R: | | |
|---|---|---|
| | —OH | 72-1 |
| | —$OC_2H_5$ | 72-4 |
| | —$SCH_3$ | 72-7 |

-continued
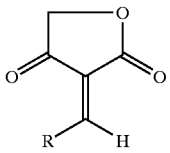
| R: | | |
|---|---|---|
| | —OH | 72-2 |
| | —$O^-Na^+$ | 72-3 |
| | —$OCH_3$ | 72-5 |
| | —$O^-Ag^+$ | 72-6 |
| | —$SC_4H_9$ | 72-8 |
| | —$S^-K^+$ | 72-9 |
| | —Cl | 72-11 |
72-10
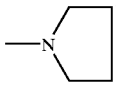
72-12
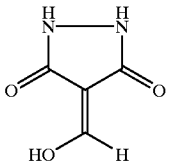
72-13
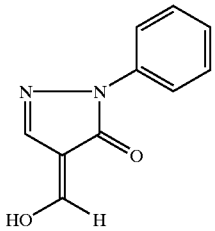
72-14
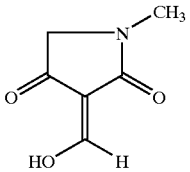
72-15
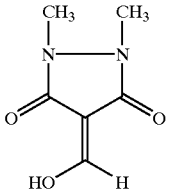
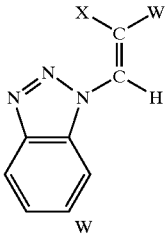
| X | —$COCH_3$ | —$COCF_3$ | —CHO | —$COCH_2SCH_3$ | —$SO_2CH_3$ |
|---|---|---|---|---|---|
| —$COOC_2H_5$ | 73-1 | 74-1 | 75-1 | 76-1 | 77-1 |
| —$COCOOC_2H_5$ | 73-2 | 74-2 | 75-2 | 76-2 | 77-2 |
| —$COCH_3$ | 73-3 | 74-3 | 75-3 | 76-3 | 77-3 |
| —$COCF_3$ | — | 74-4 | 75-4 | 76-4 | 77-4 |
| —CHO | — | — | 75-5 | 76-5 | 77-5 |
| —$SO_2CH_3$ | — | — | — | 76-6 | 77-6 |
| —$SO_2CF_3$ | 73-4 | 74-5 | 75-6 | 76-7 | 77-7 |
| —$COCH_2SCH_3$ | — | — | — | 76-8 | — |
| 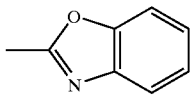 | 73-5 | 74-6 | 75-7 | 76-9 | 77-8 |
| —$COOC_2H_4SCH_3$ | 73-6 | 74-7 | 75-8 | 76-10 | 77-9 |
| —$COCOOC_2H_4SCH_3$ | 73-7 | 74-8 | 75-9 | 76-11 | 77-10 |
| —$COCONHC_2H_4SCH_3$ | 73-8 | 74-9 | 75-10 | 76-12 | 77-11 |

-continued
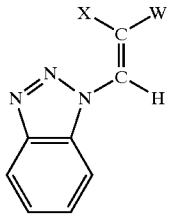
W
| X | —$SO_2CF_3$ | 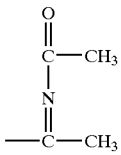 | 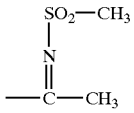 | 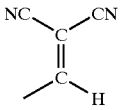 | 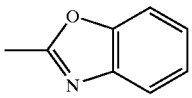 |
|---|---|---|---|---|---|
| —$COOC_2H_5$ | 78-1 | 79-1 | 80-1 | 81-1 | 82-1 |
| —$COCOOC_2H_5$ | 78-2 | 79-2 | 80-2 | 81-2 | 82-2 |
| —$COCH_3$ | — | 79-3 | 80-3 | 81-3 | — |
| —$COCF_3$ | — | 79-4 | 80-4 | 81-4 | — |
| —CHO | — | 79-5 | 80-5 | 81-5 | — |
| —$SO_2CH_3$ | — | 79-6 | 80-6 | 81-6 | — |
| —$SO_2CF_3$ | 78-3 | 79-7 | 80-7 | 81-7 | 82-3 |
| —$COCH_2SCH_3$ | 78-4 | 79-8 | 80-8 | 81-8 | — |
| 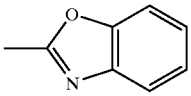 | 78-5 | 79-9 | 80-9 | 81-9 | 82-4 |
| —$COOC_2H_4SCH_3$ | 78-6 | 79-10 | 80-10 | 81-10 | 82-5 |
| —$COCOOC_2H_4SCH_3$ | 78-7 | 79-11 | 80-11 | 81-11 | 82-6 |
| —$COCONHC_2H_4SCH_3$ | 78-8 | 79-12 | 80-12 | 81-12 | 82-7 |
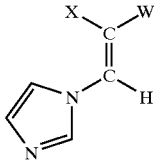
W
| X | —$COCH_3$ | —$COCF_3$ | —CHO | —$COCH_2SCH_3$ | —$SO_2CH_3$ |
|---|---|---|---|---|---|
| —$COOC_2H_5$ | 83-1 | 84-1 | 85-1 | 86-1 | 87-1 |
| —$COCOOC_2H_5$ | 83-2 | 84-2 | 85-2 | 86-2 | 87-2 |
| —$COCH_3$ | 83-3 | 84-3 | 85-3 | 86-3 | 87-3 |
| —$COCF_3$ | — | 84-4 | 85-4 | 86-4 | 87-4 |
| —CHO | — | — | 85-5 | 86-5 | 87-5 |
| —$SO_2CH_3$ | — | — | — | 86-6 | 87-6 |
| —$SO_2CF_3$ | 83-4 | 84-5 | 85-6 | 86-7 | 87-7 |
| —$COCH_2SCH_3$ | — | — | — | 86-8 | — |
| 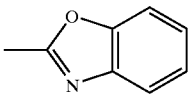 | 83-5 | 84-6 | 85-7 | 86-9 | 87-8 |
| —$COOC_2H_4SCH_3$ | 83-6 | 84-7 | 85-8 | 86-10 | 87-9 |
| —$COCOOC_2H_4SCH_3$ | 83-7 | 84-8 | 85-9 | 86-11 | 87-10 |
| —$COCONHC_2H_4SCH_3$ | 83-8 | 84-9 | 85-10 | 86-12 | 87-11 |

-continued

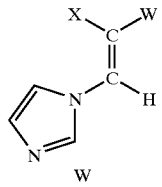

| X | —$SO_2CF_3$ | 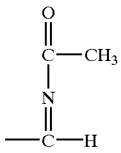 | 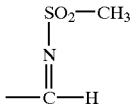 | 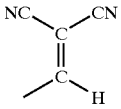 | 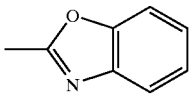 |
|---|---|---|---|---|---|
| —$COOC_2H_5$ | 88-1 | 89-1 | 90-1 | 91-1 | 92-1 |
| —$COCOOC_2H_5$ | 88-2 | 89-2 | 90-2 | 91-2 | 92-2 |
| —$COCH_3$ | — | 89-3 | 90-3 | 91-3 | — |
| —$COCF_3$ | — | 89-4 | 90-4 | 91-4 | — |
| —CHO | — | 89-5 | 90-5 | 91-5 | — |
| —$SO_2CH_3$ | — | 89-6 | 90-6 | 91-6 | — |
| —$SO_2CF_3$ | 88-3 | 89-7 | 90-7 | 91-7 | 92-3 |
| —$COCH_2SCH_3$ | 88-4 | 89-8 | 90-8 | 91-8 | — |
| 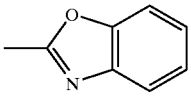 | 88-5 | 89-9 | 90-9 | 91-9 | 92-4 |
| —$COOC_2H_4SCH_3$ | 88-6 | 89-10 | 90-10 | 91-10 | 92-5 |
| —$COCOOC_2H_4SCH_3$ | 88-7 | 89-11 | 90-11 | 91-11 | 92-6 |
| —$COCONHC_2H_4SCH_3$ | 88-8 | 89-12 | 90-12 | 91-12 | 92-7 |

The addition amount, depending of the grain size, halide composition and the extent of chemical sensitization of silver halide grains size, and the kind of an antifoggant, is generally 10-6 to $10^{-1}$ mol, and preferably $10^{-5}$ to $10^{-2}$ mole per mole of silver halide.

The contrast-increasing agents such as hydrazine derivatives, quaternary onium compounds and vinyl compounds, which may be used alone or in combination can be incorporated into any one of constituting layers of the photothermographic material, preferably at least one of the constituting layers of the light-sensitive layer side, and more preferably a light-sensitive layer or a layer adjacent thereto.

Binders suitable for the photothermographic material used in the invention are transparent or translucent, and generally colorless. Binders are natural polymers, synthetic resins, and polymers and copolymers, other film forming media; for example, gelatin, gum arabic, polylvinyl alcohol), hydroxyethyl cellulose, cellulose acetate, cellulose acetatebutylate, poly(vinyl pyrrolidone), casein, starch, poly (acrylic acid), poly(methyl methacrylic acid), poly(vinyl chloride), poly(methacrylic acid), copoly(styrene-maleic acid anhydride), copoly(styrene-acrylonitrile, copoly (styrene-butadiene, poly(vinyl acetal) series [e.g., polyvinyl formal)and poly(vinyl butyral), polyester series, polyurethane series, phenoxy resins, poly(vinylidene chloride), polyepoxide series, polycarbonate series, poly(vinyl acetate) series, cellulose esters, poly(amide) series.

Hydrophilic or hydrophobic binders are sable in this invention but hydrophobic transparent binders are preferred to reduce fogging caused after thermal development. Examples of preferred binders include polyvinyl butyral, cellulose acetate, cellulose acetate butyrate, polyester, polycarbonate, polyacrylic acid, and polyurethane. Of these, polyvinyl butyral, cellulose acetate, cellulose acetate butyral and polyester are preferred.

Alternative preferred binder is a polymer which is soluble or dispersible in aqueous solvent (water solvent) and exhibits an equilibrium moisture content at 25° C. and 60% RH of not more than 2 wt %. Using such a polymer, a coating solution containing 30 wt % or more water solvent can be coated to form a light sensitive layer. However, in cases when the moisture content exceeds the above-described value, an increase of fog occurs after being stored in a high humid atmosphere. The aqueous solvent in which the polymer is soluble or dispersible is water or a mixture of water and a water-miscible organic solvent of 70 wt % or less. Examples of the water-miscible organic solvent include alcohols such as methyl alcohol, ethyl alcohol, and propyl alcohol; celllosolves such as methyl cellosolve, ethyl cellosolve and butyl cellosolve; ethyl acetate and dimethylformylamide.

In this invention, the expression, the aqueous solvent is employed even in cases where a polymer is not thermodynamically dissolved but exists in the form of a dispersion. The equilibrium moisture content at 25° C. and 60% RH is defined as below:

$$\text{Moisture content at 25° C. and 60\% RH} = \{(W1-W0)/W0\} \times 100 \ (\text{wt \%})$$

where W1 is a weight of the polymer which has been equilibrated in an atmosphere of 25° C. and 60% RH and W0 is a weight of the polymer which has been completely dried at 25° C.

Measurement can be carried out in the manner as described in Examples. If the polymers described above are soluble or dispersible in the aqueous solvent and exhibit an equilibrium moisture content of not more than 2 wt %, there is specifically no litation.

There can be provided a light-insensitive layer Dn the outer side of the light-sensitive layer to protect the surface of the photothermographic material or prevent it from abrasion. Binders used in the light-insensitive layer may be the same with or different from those used in the light-sensitive layer.

In addition to the contrast-increasing agent and binder, the photothermographic material used in this invention contains light sensitive silver halide, organic silver salt and a reducing agent for a silver ion.

The thickness of a support is preferably 110 to 150 μm, more preferably 110 to 140 μm, and still more preferably 115 to 135 μm; the thickness of the image forming layer is preferably 3 to 15 μm, and more preferably 7 to 11 μm; and the silver content of the image forming layer is preferably 0.3 to 1.5 $g/m^2$, and more preferably 0.7 to 1.1 $g/m^2$.

In a preferred embodiment of the photothermographic materials used in this invention, a sublayer, an image forming layer and a protective layer for the image forming layer are provided on a support in this order to form the light sensitive side. The sublayer preferably comprises at least two layers and the total thickness thereof is preferably 0.2 to 5 μm, and more preferably 0.5 to 3 μm. The image forming layer thickness is preferably 5 to 13 μm, and more preferably 7 to 11 μm. The protective layer thickness id preferably 2 to 10 μm, and more preferably 4 to 8 μm. The protective layer preferably contains a matting agent, the average particle size of which is a level of 1 to 10 μm, and preferably 3 to 7 μm.

The backing coat preferably comprises on a support a sublayer, a backing layer and a backing layer-protective layer in this order. The backing layer preferably comprises at least two layers. The backing layer nearest to the support is preferably an antistatic layer containing a conductive metal oxide and/or conductive polymer. Preferred examples of the conductive metal oxide include $SnO_2$ surface-treated with Sb and preferred conductive polymers include, for example, polyanions. The total sublayer thickness is ca. 0.2 to 4 μm, and preferably 0.5 to 2 μm. The backing layer thickness is preferably 2 to 10 μm, and more preferably 4 to 8 μm. The backing layer preferably contains an antihalation dye. The thickness of the backing layer-protective layer is preferably 2 to 10 μm, and more preferably 4 to 8 μm. The protective layer preferably contains a matting layer, the average particle size of which is a level of 1 to 10 μm, and preferably 3 to 7 μm.

Silver halide grains work as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 40%; more preferably less than 30%, and most preferably from 0.1 to 20%.

Monodispersibility=(standard deviation of grain diameter)/(average grain diameter)×100(%)

The silver halide grain shape is not specifically limited, but a high ratio accounted for by a Miller index [100] plane is preferred. This ratio is preferably at least 50%; is more preferably at least 70%, and is most preferably at least 80%. Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm.

The composition of silver halide may be any of silver chloride, silver chlorobromide, silver iodochlorobromiJde, silver bromide, silver iodobromide, or silver iodide. Silver halide emulsions used in the invention can be prepared according to any method known in the art. Thus, any one of acidic precipitation, neutral precipitation and ammoniacal precipitation is applicable and the reaction mode of aqueous soluble silver salt and halide salt includes single jet addition, double jet addition and a combination thereof. Silver halide may be incorporated into the image forming layer by any means so that the silver halide is arranged so as to be close to reducible silver source. Silver halide may be mixed with a previously-prepared organic silver salt. Silver halide may be prepared by converting at least a part of the organic silver salt to silver halide through reaction of an organic acid with a halide ion silver halide, alternatively, silver halide which has been prepared may be added into a solution used for preparing an organic silver salt, and the latter is preferred. Silver halide is contained preferably in an amount of 0.75 to 30% by weight, based on an organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au.

Silver halide grain emulsions used in the invention may be desalted after the grain formation, using the methods known in the art, such as the noodle washing method and flocculation process. The photosensitive silver halides grains used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, the ligand of which has a total stability constant to a silver ion of 4.0 to 10.0 are preferred. Exemplary preferred complex salts are described in Research Disclosure 17029 and 29963. Preferred silver source is silver behenate, silver arachidate or silver stearate.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed.

Organic silver salts preferably have an average grain diameter of 0.2 to 1.2 μm and more preferably 0.35 tD 1.0 μm. The organic silver salt particles preferably are monodisperse, and the monodisperse degree is preferably 1 to 30%.

To prevent hazing of the photosensitive material, the total amount of silver halide and organic silver salt is preferably 0.5 to 2.2 g in equivalent converted to silver per $m^2$, leading to high contrast images.

Next, reducing agents for a silver ion will be described. Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963. Of these, particularly preferred reducing agents are hindered phenols. As hindered phenols, compounds represented by the following formula (A) are preferred:

Formula (A)

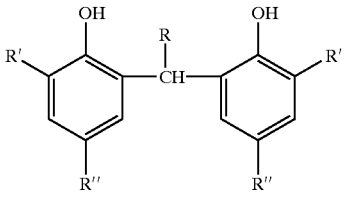

wherein R represents a hydrogen atom or an alkyl group having 1 to 10 carbon atoms (e.g., —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

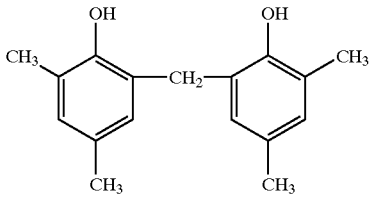

A-2

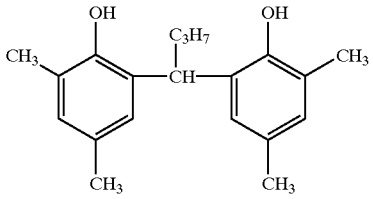

A-3

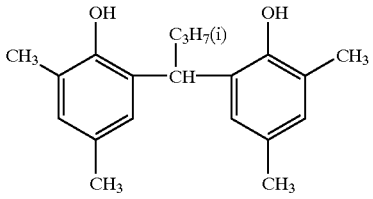

-continued

A-4

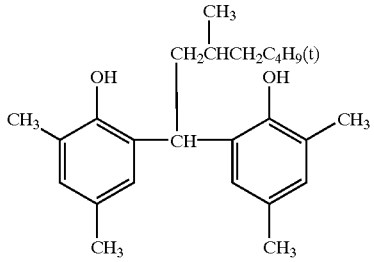

A-5

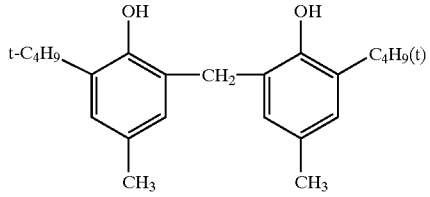

A-6

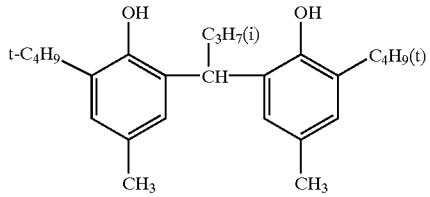

A-7

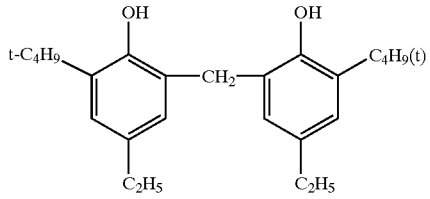

The used amount of reducing agents represented by the above-mentioned general formula (A) is preferably between $1\times10^{-2}$ and 10 moles, and is more preferably between $1\times10^{-2}$ and 1.5 moles per mole of silver.

Various surfactants can be employed as a coating aid in the photothermographic materials used in this invention. Specifically, fluorinated surfactants are preferably used to improve antistatic property and spot coating trouble.

Suitable image tone modifiers usable in the invention include those used in the invention b). Tone modifiers are preferably incorporated into the thermally developable photosensitive material used in the present invention. Examples of preferred tone modifiers, which are disclosed in Research Disclosure Item 17029. The photothermographic materials used in this invention may contain a mercapto compound, disulfide compound or thione compound to inhibit or accelerate development, to enhance spectral sensitization efficiency, or to enhance storage stability of the unprocessed photographic material.

Antifoggants may be incorporated into the thermally developable photothermographic material to which the present invention is applied.

There can be used sensitizing dyes in the photothermographic material. Particularly, there can advantageously be selected sensitizing dyes having the spectral sensitivity suitable for spectral characteristics of light sources of various types of scanners.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in Research Disclosure Item 17029 (on page 9 to 15, June, 1978) and can be employed.

Supports employed in the present invention are preferably, in order to minimize the deformation of images after development processing, plastic films (for example, polyethylene terephthalate, polycarbonate, polyimide, nylon, cellulose triacetate, polyethylene naphthalate). Furthermore, thermally processed plastic supports may be employed. Specifically, preferred supports include, for example, polyethylene terephthalate (hereinafter, also denoted as PET) and a plastic resin support containing a styrene type polymer having a syndiotactic structure.

In this invention, the photothermographic materials display their performance when subjected to imagewise exposure using a scanner having a light source of laser within the wavelengths of 700 to 1,000 nm. The photothermographic material is preferably subjected to thermal development after being subjected to pre-heating, while being horizontally transported. The total time of the pre-heating and the thermal development is preferably not more than 45 sec., more preferably 5 to 40 sec., and still more preferably 5 to 40 sec., and 5 to 30 sec. The preferred temperature is 30 to 150° C., and more preferably 100 to 140° C. The preheating temperature is preferably 30 130° C., and more preferably 50 to 120° C.

EXAMPLES

Embodiments of the invention will be further described based on examples, but the invention is not limited to these examples.

Example 1

Preparation of PET Support

After being dried at 130° C., PET pellets were melted at 300° C., extruded through T-type die and immediately thereafter cooled to prepare unstretched film. Using rolls different in circumferential speed, the film is longitudinally stretched to 3.0 times and then laterally stretched to 4.5 times by means of a tenter, in which the temperature was 110° C. and 130° C., respectively. Thereafter, the stretched film was thermally fixed at 240° C. for 20 sec. and then subjected to relaxation in the lateral direction to 4%. Then, after the portion corresponding to the tenter chuck section was slitted and both edge portions were subjected to a knurling treatment and winded at 4 kg/cm$^2$. There was thus obtained a 2.4 m width, 800 m long and 125 $\mu$m thick PET film. Both sides of the thus obtained 125 $\mu$m thick PET film which had been biaxially stretched and thermally fixed were subjected to corona discharge at 8 w/m$^2$.

Onto the surface of one side thereof, the subbing coating composition a-1 descried below was applied so as to form a dried layer thickness of 0.8 $\mu$m, which was then dried. The resulting coating was designated Subbing Layer A-1. Onto the opposite surface, the subbing coating composition b-1 described below was applied to form a dried layer thickness of 0.8 $\mu$m. The resulting coating was designated Subbing Layer B-1.

Subbing Coating Composition a-1

| | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis (ethyleneurea) | 0.8 g |
| Polystyrene fine particles (av. Size 3 $\mu$m) | 0.05 g |
| Colloidal silica (av. size 90 $\mu$m) | 0.1 g |
| Water to make | 1 liter |

Subbing Coating Composition b-1

| | |
|---|---|
| $SnO_2$/Sb (9/1 by weight, av. Size 0.18 $\mu$m) | 200 mg/m$^2$ |
| Latex liquid (solid portion of 30%) of a copolymer consisting of butyl acrylate (30 weight %) styrene (20 weight %) glycidyl acrylate (40 weight %) | 270 g |
| (C-1) | 0.6 g |
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/m$^2$ minute. Onto the Subbing Layer A-1, the upper subbing layer coating composition a-2 described below was applied so as to form a dried layer thickness of 0.8 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

Upper Subbing Layer Coating Composition a-2

| | |
|---|---|
| Gelatin in an amount (weight) to make | 0.4 g/m$^2$ |
| (C1) | 0.2 g |
| (C-2) | 0.2 g |
| (C3) | 0.1 g |
| Silica particles (av. size 3 $\mu$m) | 0.1 g |
| Water to make | 1 liter |

Upper Subbing Layer Coating Composition b-2

| | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

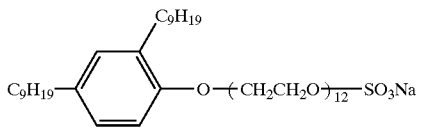

-continued (C-2)

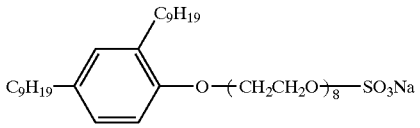

(C-3)

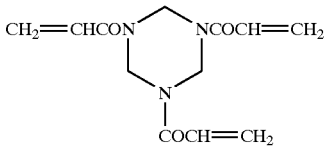

(C-4)

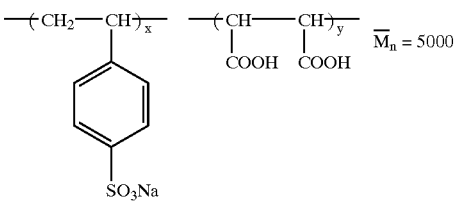

($\overline{M}_n$ is a number average molecular weight)
x:y = 75:25 (weight ratio)

(C-5)

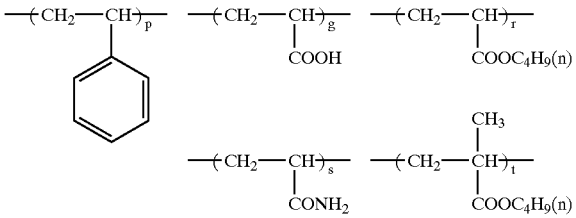

p:g:r:s:t = 40:5:10:5:40 (weight ratio)

(C-6)

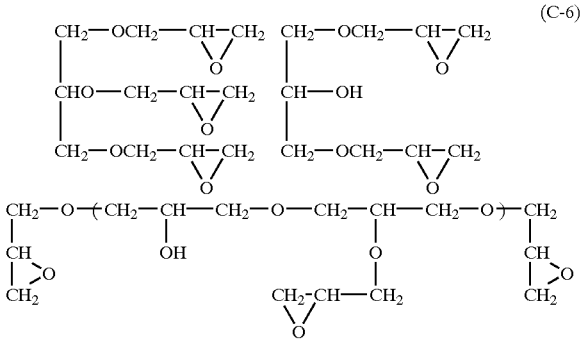

Mixture consisting of the three compounds illustrated above

Thermal Treatment of Support

In the subbing and drying process of the subbed support, the support was heated at 140° C. and then gradually cooled. The support was winded at a tension of 3 kg/cm$^2$. Preparation of Light-sensitive Silver Halide Emulsion A In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing sodium chloride, potassium bromide, potassium iodide (in a molar ratio of 60/38/2), and $1\times10^{-6}$ mol/mol Ag of $[Ir(NO)Cl_5]$ and $1\times10^{-6}$ mol/mol Ag of rhodium chloride were added by the controlled double-jet method, while the pAg was maintained at 7.7. Thereafter, 4-hydroxy-6-methyl-1,3,3a,7-tetraazaindenea was added and the pH was adjusted to 5 using NaOH. There was obtained cubic silver iodobromochloride grains having an average grain size of 0.06 $\mu$m, a variation coefficient of the projection area equivalent diameter of 10 percent, and the proportion of the {100} face of 87 percent. The resulting emulsion was flocculated to remove soluble salts, employing a flocculating agent.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. to obtain an aqueous sodium behEnate solution.

Preparation of Pre-formed Emulsion of Silver Behenate and Silver Halide Emulsion To the aqueous sodium behenate solution described above was added 15.1 g of silver halide emulsion A. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse particles having an average particle size of 0.8 $\mu$m and a monodisperse degree (i.e., variation coefficient of particle size) of 8%. After forming flock of the dispersion, water was removed therefrom and after washing and removal of water were repeated six times, drying was conducted.

Preparation of Light-sensitive Emulsion

To a half of the thus prepared pre-formed emulsion were gradually added 544 g of methyl ethyl ketone solution of 17 wt % polyvinyl butyral (average molecular weight of 3,000) and 107 g of toluene. Further, the mixture was dispersed by a media dispersing machine using 0.5 mm $ZrO_2$ beads mill and at 4,000 psi and 30° C. for 10 min.

On both sides of the support described above, the following layers were simultaneously coated to prepare photothermographic material sample. Drying was conducted at 60° C. for 15 min.

Back Coating

On the B-2 layer of the support, the following composition was coated.

| | |
|---|---|
| Cellulose acetate-butylate (10% methyl ethyl ketone solution) | 15 ml/m$^2$ |
| Dye-A | 7 mg/m$^2$ |
| Dye-B | 7 mg/m$^2$ |
| Dye-C | 7 mg/m$^2$ |
| Matting agent: monodisperse silica having a monodisperse degree of 15% and average size of 8 $\mu$m | 90 mg/m$^2$ |
| $C_8F_{17}(CH_2CH_2O)_{12}C_8H_{17}$ | 50 mg/m$^2$ |
| $C_9F_{19}$—$C_6H_4$—$SO_3Na$ | 10 mg/m$^2$ |
| $C_9F_{19}$—$SO_2N(C_3H_7)CH_2COONa$ | 5 mg/m$^2$ |

Dye-A

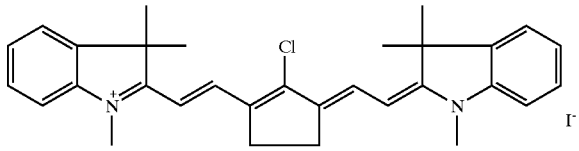

-continued

Dye-B

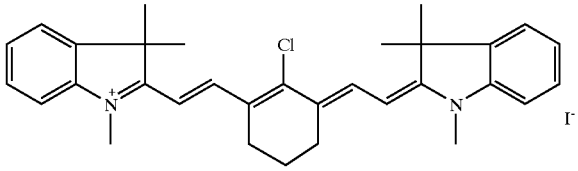

Dye-C

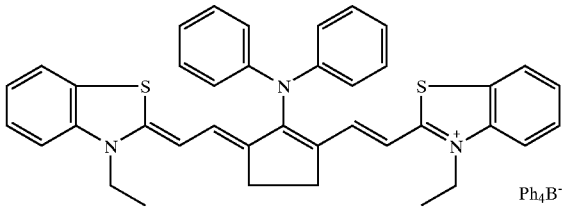

Coating on the Light-sensitive Layer Side

On the sub-layer A-2 side of the support, a photosensitive layer having the following composition was coated so as to have silver coverage of 1.5 g/m$^2$. Light-sensitive layer coating solution

| | |
|---|---|
| Light-sensitive emulsion | 240 g |
| Sensitizing dye (0.1% methanol solution) | 1.7 ml |
| Pyridinium bromide perbromide (6% methanol solution) | 3 ml |
| Calcium bromide (0.1% methanol solution) | 1.7 ml |
| Oxidizing agent (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Tribromethylsulfoquinoline (5% methanol solution) | 17 ml |
| Hydrazine derivative H-1-1 | 0.4 g |
| Phthalazinone | 0.6 g |
| 4-Methylphthalic acid | 0.25 g |
| Tetrachlorophthalic acid | 0.2 g |
| Calcium carbonate (av. size of 3 $\mu$m) | 0.1 g |
| 1,1-Bis(2-2-hydroxy-3,5-dimethylphenyl)-2-methylpropane (20% methanol solution) | 20.5 ml |
| Isocyanate compound (Desmodur N3300, Available from Movey Corp.) | 0.5 g |
| d-1 | 0.3 g |
| d-2 | 0.4 g |
| d-3 | 0.3 g |
| d-4 | 0.2 g |
| d-5 | 0.3 g |

d-1

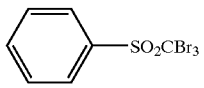

d-2

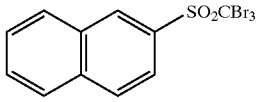

-continued d-3

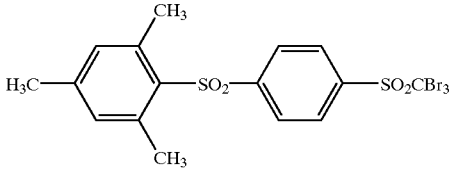

d-4

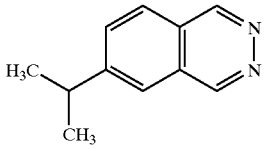

d-5

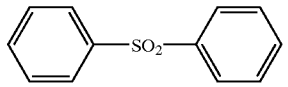

Surface Protective Layer Coating Solution

The following composition was coated on the photosensitive layer simultaneously therewith.

| | |
|---|---|
| Acetone | 5 ml/m$^2$ |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Matting agent, monodisperse silica having monodispersity of 10% and a mean size of 4 $\mu$m | 5 mg/m$^2$ |
| $CH_2{=}CHSO_2CH_2CONHCH_2CH_2NHCOCH_2SO_2CH{=}CH_2$ | 35 mg/m$^2$ |
| Surfactant $C_{12}F_{25}(CH_2CH_2O)_{10}C_{12}F_{25}$ | 10 mg/m$^2$ |
| $C_8F_{17}{-}C_6H_4{-}SO_3Na$ | 10 mg/m$^2$ |

After removing binder of the coated sample, electronmicroscopic observation by the replica method proved that organic salt grains were monodisperse grains of a monodisperse degree of 5% and 90% of the total grains were accounted for by tabular grains having a major axis of 0.5±0.05 $\mu$m, a minor axis of 0.4±0.05 $\mu$m and a thickness of 0.01 $\mu$m.

The thus coated five kinds of photothermographic materials were each made into a roll form of 590 mm×61 m and packaged in an ambient light handleable form.

Figures 1, 2:
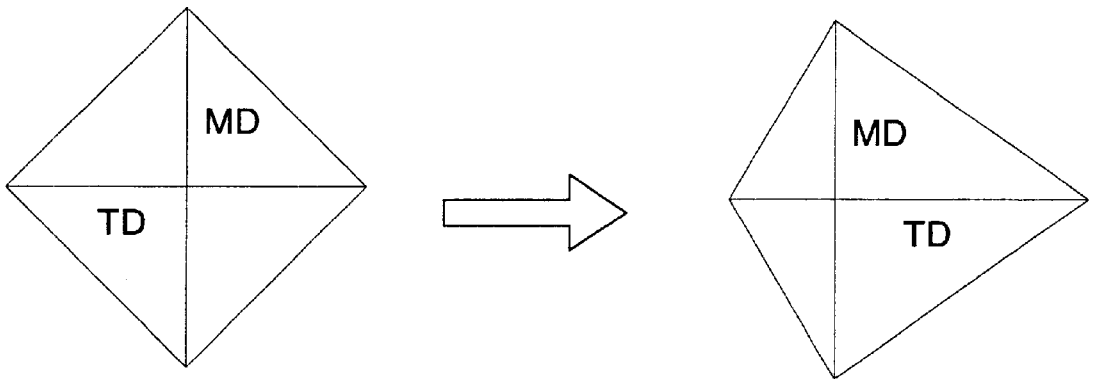
Figures 1, 2:
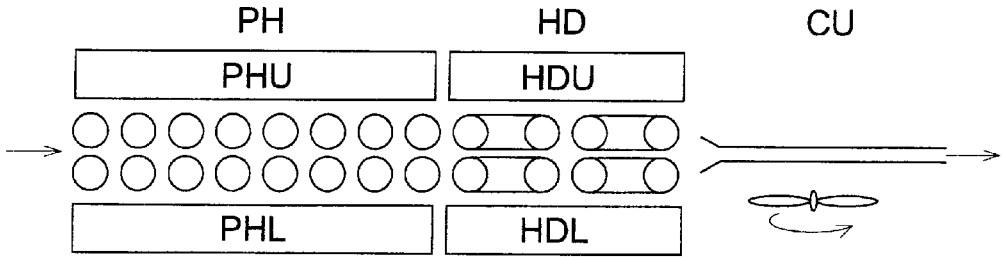
Figure 2:
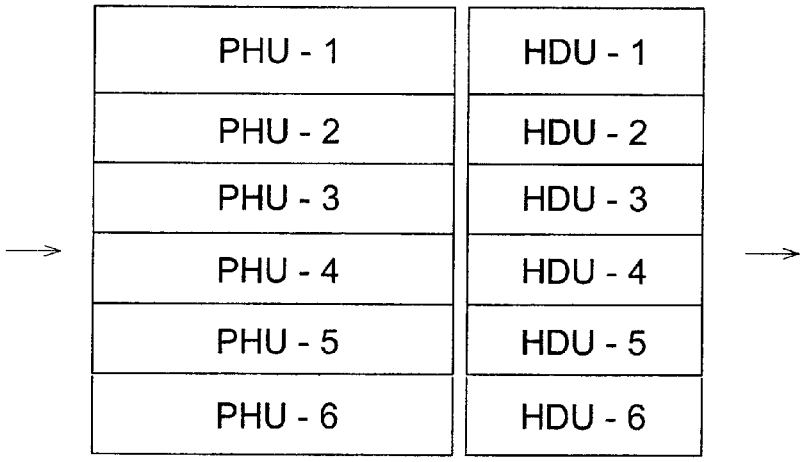
Figures 2, 3:
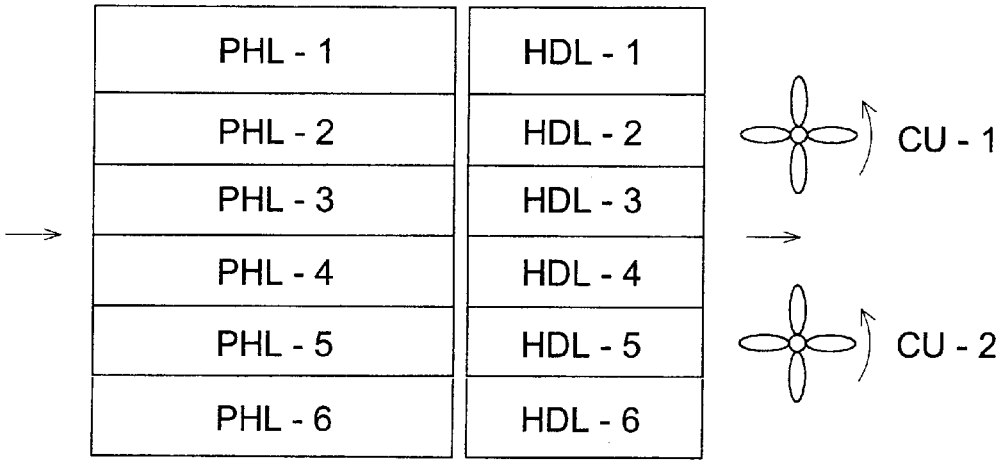
Figure 3:
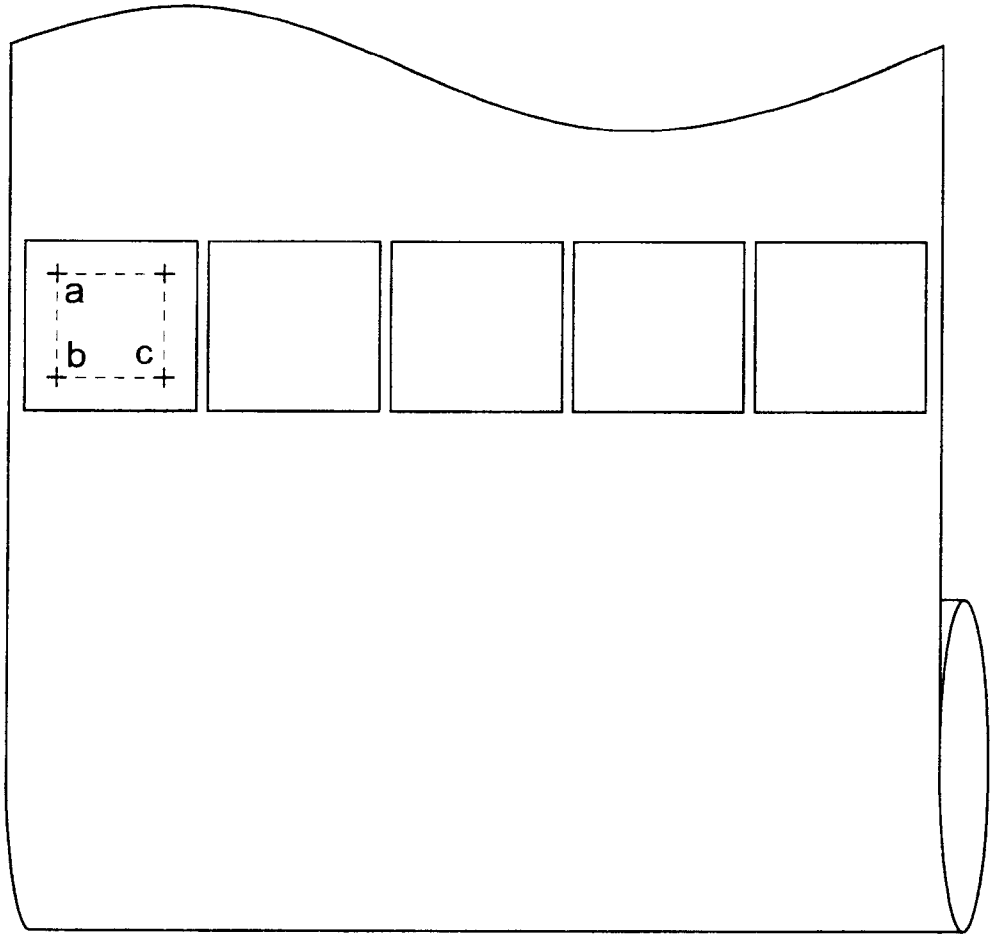

FIGS. 2-1 through 2-3 schematically illustrate the constitution of a thermal processor used in this invention.

The processor is comprised of a pre-heating section (PH) having 8 pairs of opposed silicone rubber rollers and a heat-developing section (HD) having a belt transport machine, in which stainless steel belts was wound onto 8 silicone rubber rollers. The diameter of each roller is 40 mm. The belt of the side in contact with the photothermographic material has 2 mm thick, matted silicone rubber adhered to the stainless steel belt.

In FIG. 2-1, PHU is an upper heat source in the preheating section (PH), which is divided into six sub-sections, each of which can be independently controlled. Sheath heaters are employed as a heat source and the heater length of each unit is 500 mm. PHL is a lower heat source in the pre-heating section (PH), which is also divided into six sub-sections, each of which can be independently controlled. Sheath heaters are also employed as a heat source and the heater length of each unit is 500 mm. HDU is an upper heat source in the heat-developing section (HD), which is divided into six sections, each of which can be independently controlled. Sheath heaters are employed as a heat source and the heater length of each unit is 330 mm. HDL is a lower heat source in the heat-developing section (HD), which is also divided into six sections, each of which can be independently controlled. Sheath heaters are also employed as a heat source and the heater length of each unit is 330 mm. The pre-heating section and heat-developing section each are insulated with 20 mm thick urethane foam.

In a cooling section (CU), 3 mm thick stainless steel plates are provided above and below, and the spacing between the stainless steel plates is ca. 10 mm, in which the lower stainless steel plate is air-cooled with a 4-bladed fan of a 150 mm diameter, supplied at 24 DC V/0.1 A power.

The processing line-speed is 25 mm/sec and the top to top time (i.e., the period between the time when the top of the sample enters the pre-heating section and the time when the top comes out the cooling section) is 39 sec. Thus light-sensitive layer side of the photothermographic material is upwardly processed. The nipping pressure of opposed rolers is 50 g.

The heat-developing section has six locations in which the temperature is independently controlled. In cases, where the temperature is not varied between the locations, the six locations are maintained at the same temperature (e.g., within ±0.3° C.); in cases where the temperature is varied, for example, the first, second and third locations and the fourth, fifth and sixth locations are each maintained at the same temperature. FIGS. 2-2 and 2-3 illustrate such situations. In FIGS. 2-2 and 2-3, the transporting direction of the photothermographic material is designated with an arrow.

Measurement of Distortion

As shown in FIG. 3, five 10 cm square samples were cut out across the width direction of a 590 mm wide roller. Scratches of "+" shape were made with a cutter at the corners of the 10 cm square and an angle at the corners of a, b or c was measured. After each sample was allowed to stand in an atmosphere of 23° C. and 50% RH for at least 2 hrs., measurement was made in the same atmosphere.

Further, samples each were thermally processed under the temperature condition as shown in Table 1 and after allowed to stand in an atmosphere of 23° C. and 50% RH for at least 2 hrs., measurements were made in the same manner as before being processed. All five sheets in the width direction were measured and the largest variation in angle between before and after being processed in each of a, b and c are shown in Table 1. Measurements were made using an apparatus, Measurescope 20, DP-200, SC-102 (available from NIKON Corp.) Cooling was made using fan CU-1 and CU-2 at a rate of 500 rpm.

Measurement of Moiré

Figure 4:
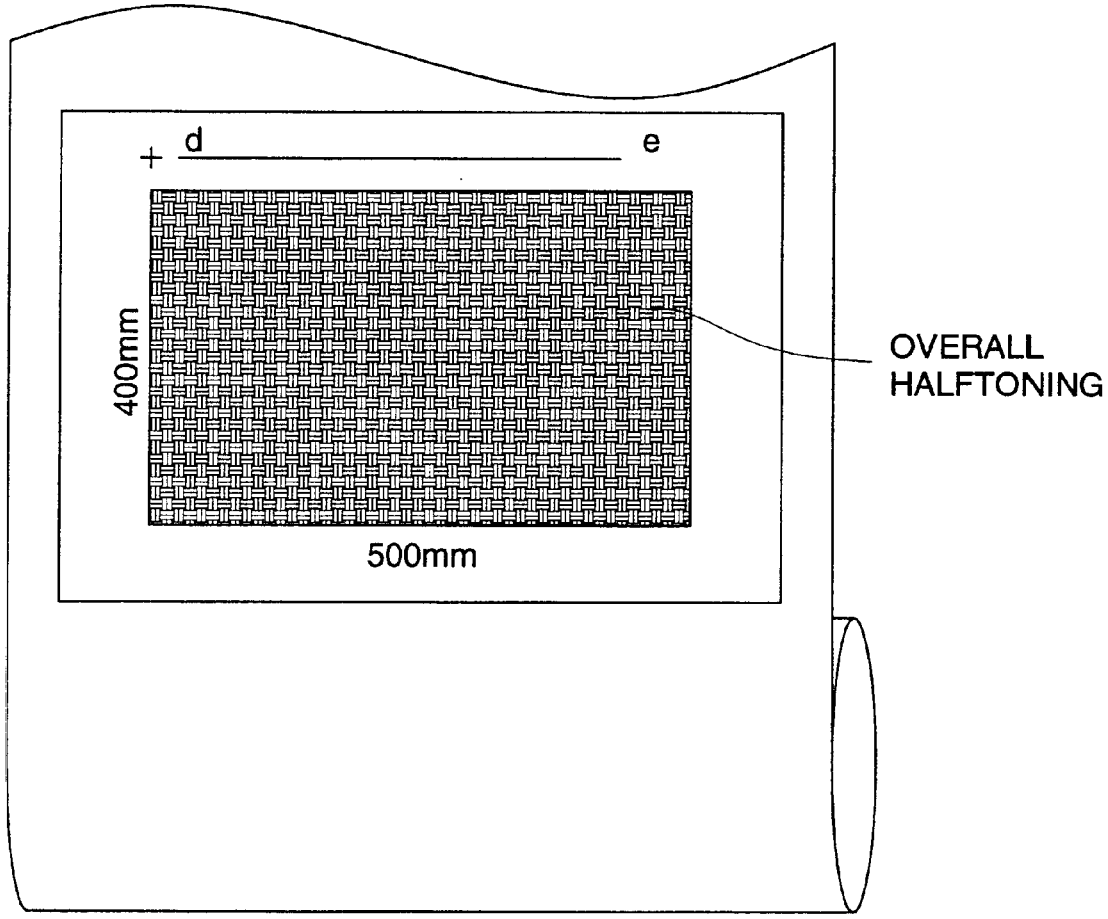
FIG. 4 indicates a measurement method of moiré.

Replacing the light source used in FT-290R (available from NEC Corp.) by an infrared 780 nm high power semiconductor laser, each sample of 400 mm in the roll-reeling direction and 500 mm in the width direction was overall exposed through a halftone screen (of 175 lines) in an exposure amount giving a density 4.5 when fully exposed. Using a square dot screen, exposure was made through a Y-plate at an angle of 0°, an M-plate at an angle of 45°, a C-plate at an angle of 15° and K-plate at an angle of 75° so that each dot percentage was 20%. Four processed sheet samples were placed on a viewing box by superposing a register mark and line d-e, as shown in FIG. 4, of one sheet on that of another sheet and the extent of moiré was evaluated based on 10 grades, in which "10" indicated no moire observed, "5" indicated moire being regularly observed, and "1" indicated an unacceptable level of moiré for practical use.

Results thereof are shown in Table 1.

TABLE 1

| Experiment | PHU | | PHL | | HDU | | HDL | | Δa | Δb | Δc | | |
|---|---|---|---|---|---|---|---|---|---|---|---|---|---|
| No. | 1-6 | ° C. | 1-6 | ° C. | 1-6 | ° C. | 1-6 | ° C. | (angle) | (angle) | (angle) | Moire | Remark |
| 1 | 1-6 | 110 | 1-6 | 110 | 1-6 | 125 | 1-6 | 125 | 0.063 | −0.060 | 0.056 | 5.0 | Comp. |
| 2 | 1-6 | 110 | 1-6 | 110 | 1-6 | 125 | 1, 2, 3 | 123 | | | | | |
| | | | | | | | 4, 5, 6 | 129 | 0.050 | −0.058 | 0.050 | 5.0 | Comp. |
| 3 | 1-6 | 110 | 1-6 | 110 | 1-6 | 125 | 1, 2, 3 | 129 | | | | | |
| | | | | | | | 4, 5, 6 | 123 | 0.065 | −0.062 | 0.056 | 4.0 | Comp. |
| 4 | 1-6 | 110 | 1-6 | 110 | 1-6 | 125 | 1, 2 | 122 | | | | | |
| | | | | | | | 3, 4 | 125 | | | | | |
| | | | | | | | 5, 6 | 122 | 0.030 | −0.028 | 0.026 | 7.0 | Inv. |
| 5 | 1-6 | 110 | 1-6 | 110 | 1-6 | 125 | 1, 2 | 122 | | | | | |
| | | | | | | | 3, 4 | 125 | | | | | |
| | | | | | | | 5, 6 | 128 | 0.027 | −0.028 | 0.026 | 7.0 | Inv. |
| 6 | — | — | — | — | 1, 2, 3 | 123 | 1-6 | 125 | | | | | |
| | | | | | 4, 5, 6 | 129 | | | 0.051 | −0.057 | 0.052 | 5.0 | Comp. |
| 7 | — | — | — | — | 1, 2, 3 | 129 | 1-6 | 125 | | | | | |
| | | | | | 4, 5, 6 | 123 | | | 0.063 | −0.060 | 0.058 | 4.0 | Comp. |
| 8 | — | — | — | — | 1, 2 | 122 | 1-6 | 125 | | | | | |
| | | | | | 3, 4 | 125 | | | | | | | |
| | | | | | 5, 6 | 128 | | | 0.027 | −0.026 | 0.025 | 7.0 | Inv. |
| 9 | — | — | — | — | 1, 2 | 122 | 1, 2 | 122 | | | | | |
| | | | | | 3, 4 | 125 | 3, 4 | 125 | | | | | |
| | | | | | 5, 6 | 128 | 5, 6 | 128 | 0.015 | −0.015 | 0.015 | 8.0 | Inv. |
| 10 | 1, 2 | 107 | 1, 2 | 107 | 1, 2, 3 | 123 | 1, 2, 3 | 123 | | | | | |
| | 3, 4 | 110 | 3, 4 | 110 | 4, 5, 6 | 129 | 4, 5, 6 | 129 | | | | | |
| | 5, 6 | 113 | 5, 6 | 113 | | | | | 0.052 | −0.057 | 0.054 | 4.0 | Comp. |

EXAMPLE 2

The photothermographic material used in Example 1 was also used. Using the processor used in Example 1, processing was made, provided that in the cooling section, heat developed sample each were cooled under the conditions as shown in Table 2. In cases where "CU-3" is shown in the Table, CU-2 was placed in the center of the width direction and CU-1 and CU-3 were arranged in both sides. The processing conditions and evaluation results are shown in Table 2.

TABLE 2

| Experiment | PHU | | PHL | | HDU | | HDL | | CU-1 | CU-2 | CU-3 | Δa | Δb | Δc | | |
|---|---|---|---|---|---|---|---|---|---|---|---|---|---|---|---|---|
| No. | 1-6 | ° C. | 1-6 | ° C. | 1-6 | ° C. | 1-6 | ° C. | rpm | rpm | rpm | (angle) | (angle) | (angle) | Moire | Remark |
| 1 | 1-6 | 110 | 1-6 | 110 | 1-6 | 125 | 1-6 | 125 | 500 | 500 | — | 0.065 | −0.061 | 0.056 | 5.0 | Comp. |
| 2 | 1-6 | 110 | 1-6 | 110 | 1-6 | 125 | 1-6 | 125 | 750 | 750 | — | 0.060 | −0.059 | 0.053 | 5.0 | Comp. |
| 3 | 1-6 | 110 | 1-6 | 110 | 1-6 | 125 | 1-6 | 125 | 750 | 500 | — | 0.028 | −0.027 | 0.026 | 7.0 | Inv. |
| 4 | 1-6 | 110 | 1-6 | 110 | 1-6 | 125 | 1-6 | 125 | 1000 | 500 | — | 0.026 | −0.025 | 0.023 | 7.0 | Inv. |
| 5 | 1-6 | 110 | 1-6 | 110 | 1-6 | 125 | 1-6 | 125 | 1000 | 750 | 500 | 0.017 | −0.016 | 0.017 | 8.0 | Inv. |
| 6 | 1-6 | 110 | 1-6 | 110 | 1, 2 | 122 | 1, 2 | 122 | | | | | | | | |
| | | | | | 3, 4 | 125 | 3, 4 | 125 | | | | | | | | |
| | | | | | 5, 6 | 128 | 5, 6 | 128 | 1000 | 750 | 500 | 0.013 | −0.014 | 0.013 | 8.5 | Inv. |

EXAMPLE 3

A photothermographic material was prepared and evaluated in a manner similar to Example 1, provided that the preparation of the photothermographic material was varied as described below.

Preparation of Organic Silver Salt

To a mixture of 4.4 g of arachidic acid, 39. 4 g of behenic acid and 770 ml distilled water were added 103 ml of an aqueous 1N NaOH solution in 60 min. with stirring at 85° C. to allow to react for 240 min. and then the temperature was lowered to 75° C. Subsequently, 112.5 ml aqueous solution of 19.2 g silver nitrate was added thereto in 45 sec., the reaction mixture was allowed to stand for 20 min as it was and then the temperature was lowered to 30° C. Thereafter, the solid product was filtered by the absorption filtration and washed with water until the filtrate reached a conductivity of 30 μS/cm. The thus obtained solid was treated in the form of a wet cake, without being dried. To the wet cake of 100 solid, 10 g of polyvinyl alcohol (PVA-205, available from KURARAY Co. Ltd.) and water were added to make the total amount of 500 g and were preliminary dispersed by a homomixer. The mixture was dispersed three times using a dispersing machine (Microfluidizer M-11-OS-EH, available from Microfluidex International Corp., in which G10Z interaction chamber was used), at a pressure of 1750 kg/cm2 to complete preparation of an organic silver salt microcrystal dispersion exhibiting a mean volume-weighted particle diameter of 0.93 μm. The particle size was measure using Master Sizer X, available from Malvern Instruments Ltd. Cooling procedure was made by installation of coiled heat exchangers before and after the interaction chamber to adjust the temperature of a refrigerant to an intended value.

Preparation of Solid Particle Dispersion of Material

There was prepared a solid particle dispersion of 3,4-dihydroxy-4-oxo-1,2,3-benzotriazine, 4-methylphthalic acid, 1,1-bis(2-hydroxy-3,5-dimethylphenyl)-3,5,5-trimethylhexane, phthalazine or tribrommethylphenylsulfone. To tetrachlorophthalic acid, 0.81 g of hydroxypropylmethyl cellulose and 4.2 ml of water were added with stirring and was allowed to stand for 10 hrs. in the form of slurry. Thereafter, 100 ml of zirconia-made beads of an average size of 0.5 mm was added together with the slurry to a reaction vessel and dispersed for 5 hrs. using the same dispersing machine as used in the preparation of the organic silver salt crystals to obtain a solid particle dispersion of tetrachlorophthalic acid, in which 70% was accounted for by particle of 1.0 μm or less. With regard to other materials, a solid particle dispersion of each material was similarly prepared by optimally varying the use of a surfactant and a dispersing time to obtain a desired average particle size.

Preparation of Light-sensitive Emulsion

To the organic silver salt fine crystal dispersion (silver/mole equivalent), silver halide of 12 mol %, based on silver of the organic silver salt and the following binder and materials used for thermal development were used to prepare an emulsion.

| | |
|---|---|
| Binder; Laxter 3307B (available from Dainippon Chemical Ind. Co. Ltd., comprised of SBR latex exhibiting a glass transition temperature of 17° C.) | solid 470 g |
| 1,1-bis(2-hydroxy-3,5-dimethylphenyl)-3,5,5-trimethylhexane | solid 110 g |
| Tribromomethylphenylsulfone | solid 25 g |
| 3,4-Dihydroxy4-oxo-1,2,3-benzotriazine | solid 5.2 g |
| Hydrazine derivative | solid 2.0 g |
| d-1 | 0.3 g |
| d-2 | 0.4 g |
| d-3 | 0.3 g |
| d-4 | 0.2 g |
| d-5 | 0.3 g |

Hydrazine Derivative

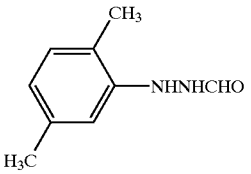

Hydrazine derivative

-continued

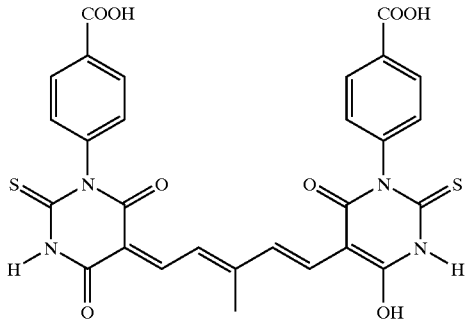

Dye

Preparation of PET Support with Backing/subbing Layers

Sublayer (a)

| | |
|---|---|
| Polymer latex, styrene/butadiene/hydroxy-ethylacrylate/divinylbenzene (67/30/2.5/0.5 wt %) | 160 mg/m$^2$ |
| 2,4-Dichloro-6-hydroxy-s-triazine | 4 mg/m$^2$ |
| Matting agent (polystyrene, average particle size of 2.4 $\mu$m) | 3 mg/m$^2$ |

Sublayer (b)

| | |
|---|---|
| Alkali-processed gelatin ($Ca^{2+}$ content of 30 ppm and a gelly strength of 230 g) | 50 mg/m$^2$ |
| Julymer ET-410 (available from DAINIPPON JUNYAKU Co. Ltd.) | 38 mg/m$^2$ |
| $SnO_2$/Sb (9/1 by weight ration, average particle size of 0.25 $\mu$) | 120 mg/m$^2$ |
| Matting agent (polymethyl methacrylate, average particle size of 5 $\mu$m) | 7 mg/m$^2$ |
| Melamine | 13 mg/m$^2$ |

On both sides of the support, sublayers (a) and (b) each were coated in this order and dried at 180° C. for 4 min. Then, on one side thereof, the conductive layer was coated and dried at 80° C. for 4 min. to prepare a PET support provided with backing/subbing layers. The thus prepared PET support was entered into a heat-treatment zone of total length of 200 m and set to a temperature of 200° C. and transported at a tension of 3 kg/cm$^2$ and a transport speed of 20 m/min, then, was allowed to pass through a zone at 40° C. for 15 sec. and wound at a tension of 10 kg/cm$^2$.

Preparation of Emulsion-side Protective Layer Coating Solution

To 500 g of a 40% polymer latex (copolymer of methyl methacrylate/styrene/2-ethylhexylacrylate/2-hydroxyethyl methacrylate/methacrylic acid=59/9/26/5/1), 262 g $H_2O$ was added, then, 14 g of benzyl alcohol as a film-making aid, 3.6 g of Cellosol 524 (available from CHUKYO YUSHI Co. Ltd.) and 3.4 g of fine polymethyl methacrylate particles of an average size of 3 $\mu$m, as a matting agent were successively added thereto and water was added to make the total amount of 1,000 g. There was thus obtained a coating solution exhibithng a viscosity of 5 cp (at 25° C.) and a pH of 3.4 (at 25° C.). The emulsion layer coating solution was coated so as to have a silver coating amount of 1.5 g/m$^2$. Simultaneously, the protective layer coating solution was coated so as to have a polymer latex amount of 1.0 g/M$^2$.

Preparation of Back-side Protective Layer Coating Solution

The same coating solution as the emulsion-side protective layer was used, except that the following wes varied:

compounds E and H were removed and the addition amounts of compounds D, F and G were varied to 1 g, 0.5 g and 1 g, respectively; and the dye described earlier was added so as to give an absorption of 0.9 at the wavelength of 780 nm.

A backing layer and its protective layer were simultaneously coated so as to give a binder amount of 2 g/m$^2$ and 1 g/m$^2$, respectively.

TABLE 3

| Experiment | PHU | | PHL | | HDU | | HDL | | Δa | Δb | Δc | | |
|---|---|---|---|---|---|---|---|---|---|---|---|---|---|
| No. | 1-6 | ° C. | 1-6 | ° C. | 1-6 | ° C. | 1-6 | ° C. | (angle) | (angle) | (angle) | Moire | Remark |
| 1 | 1-6 | 113 | 1-6 | 113 | 1-6 | 128 | 1-6 | 128 | 0.065 | −0.063 | 0.060 | 4.5 | Comp. |
| 2 | 1-6 | 113 | 1-6 | 113 | 1-6 | 128 | 1, 2, 3 | 125 | | | | | |
| | | | | | | | 4, 5, 6 | 131 | 0.059 | −0.061 | 0.055 | 4.5 | Comp. |
| 3 | 1-6 | 113 | 1-6 | 113 | 1-6 | 128 | 1, 2, 3 | 131 | | | | | |
| | | | | | | | 4, 5, 6 | 125 | 0.068 | −0.064 | 0.063 | 3.5 | Comp. |
| 4 | 1-6 | 113 | 1-6 | 113 | 1-6 | 128 | 1, 2 | 125 | | | | | |
| | | | | | | | 3, 4 | 128 | | | | | |
| | | | | | | | 5, 6 | 125 | 0.026 | −0.027 | 0.023 | 7.5 | Inv. |
| 5 | 1-6 | 113 | 1-6 | 113 | 1-6 | 128 | 1, 2 | 125 | | | | | |
| | | | | | | | 3, 4 | 128 | | | | | |
| | | | | | | | 5, 6 | 131 | 0.027 | −0.026 | 0.025 | 7.5 | Inv. |
| 6 | — | — | — | — | 1, 2, 3 | 125 | 1-6 | 128 | | | | | |
| | | | | | 4, 5, 6 | 131 | | | 0.053 | −0.058 | 0.054 | 4.5 | Comp. |
| 7 | — | — | — | — | 1, 2, 3 | 132 | 1-6 | 128 | | | | | |
| | | | | | 4, 5, 6 | 125 | | | 0.065 | −0.063 | 0.061 | 4.0 | Comp. |
| 8 | — | — | — | — | 1, 2 | 125 | 1-6 | 128 | | | | | |
| | | | | | 3, 4 | 128 | | | | | | | |
| | | | | | 5, 6 | 131 | | | 0.028 | −0.025 | 0.024 | 7.5 | Inv. |
| 9 | — | — | — | — | 1, 2 | 128 | 1, 2 | 125 | | | | | |
| | | | | | 3, 4 | 128 | 3, 4 | 128 | | | | | |
| | | | | | 5, 6 | 131 | 5, 6 | 131 | 0.013 | −0.013 | 0.011 | 8.5 | Inv. |

TABLE 3-continued

| Experiment | PHU | | PHL | | HDU | | HDL | | Δa | Δb | Δc | | |
|---|---|---|---|---|---|---|---|---|---|---|---|---|---|
| No. | 1-6 | ° C. | 1-6 | ° C. | 1-6 | ° C. | 1-6 | ° C. | (angle) | (angle) | (angle) | Moire | Remark |
| 10 | 1, 2 | 110 | 1, 2 | 110 | 1, 2, 3 | 125 | 1, 2, 3 | 125 | | | | | |
| | 3, 4 | 113 | 3, 4 | 113 | 4, 5, 6 | 131 | 4, 5, 6 | 131 | | | | | |
| | 5, 6 | 116 | 5, 6 | 116 | | | | | 0.056 | −0.059 | 0.056 | 4.0 | Comp. |

EXAMPLE 4

The photographic material used in Example 3 was also used and evaluated in the same manner as in Example 3, with respect to performance.

Results thereof are shown in Table 4.

TABLE 4

| Experiment | PHU | | PHL | | HDU | | HDL | | CU-1 | CU-2 | CU-3 | Δa | Δb | Δc | | |
|---|---|---|---|---|---|---|---|---|---|---|---|---|---|---|---|---|
| No. | 1-6 | ° C. | 1-6 | ° C. | 1-6 | ° C. | 1-6 | ° C. | rpm | rpm | rpm | (angle) | (angle) | (angle) | Moire | Remark |
| 1 | 1-6 | 113 | 1-6 | 113 | 1-6 | 128 | 1-6 | 128 | 500 | 500 | — | 0.067 | −0.063 | 0.057 | 4.5 | Comp. |
| 2 | 1-6 | 113 | 1-6 | 113 | 1-6 | 128 | 1-6 | 128 | 750 | 750 | — | 0.062 | −0.061 | 0.055 | 5.0 | Comp. |
| 3 | 1-6 | 113 | 1-6 | 113 | 1-6 | 128 | 1-6 | 128 | 750 | 500 | — | 0.026 | −0.025 | 0.025 | 7.5 | Inv. |
| 4 | 1-6 | 113 | 1-6 | 113 | 1-6 | 128 | 1-6 | 128 | 1000 | 500 | — | 0.024 | −0.023 | 0.022 | 7.5 | Inv. |
| 5 | 1-6 | 113 | 1-6 | 113 | 1-6 | 128 | 1-6 | 128 | 1000 | 750 | 500 | 0.015 | −0.016 | 0.016 | 8.0 | Inv. |
| 6 | 1-6 | 113 | 1-6 | 113 | 1, 2 | 125 | 1, 2 | 125 | | | | | | | | |
| | | | | | 3, 4 | 128 | 3, 4 | 128 | | | | | | | | |
| | | | | | 5, 6 | 131 | 5, 6 | 131 | 1000 | 750 | 500 | 0.010 | −0.011 | 0.011 | 9.0 | Inv. |

EXAMPLE 5

Preparation of PET Support

A 125 μm thick PET support was prepared in a manner similar to Example 1. Subbing was also conducted in a manner similar to Example 1. The thus subbed and dried support was subjected to the thermal treament, as shown in Table 5.

TABLE 5

| Experiment | Thermal Treatment | | | | PHU | | PHL | | HDU | | HDL | | Δa | Δb | Δc | | |
|---|---|---|---|---|---|---|---|---|---|---|---|---|---|---|---|---|---|
| No. | Temp (° C.) | Tension (kg/cm²) | Time (min) | Tension* (kg/cm²) | 1-6 | ° C. | 1-6 | ° C. | 1-6 | ° C. | 1-6 | ° C. | (angle) | (angle) | (angle) | Moire | Remark |
| 1 | 100 | 4 | 25 | 40 | 1-6 | 110 | 1-6 | 110 | 1-6 | 125 | 1, 2, 3 | 123 | 0.060 | −0.060 | 0.058 | 5.0 | Comp. |
| | | | | | | | | | | | 4, 5, 6 | 127 | | | | | |
| 2 | 145 | 8 | 25 | 40 | 1-6 | 110 | 1-6 | 110 | 1-6 | 125 | 1, 2, 3 | 123 | 0.062 | −0.055 | 0.054 | 5.0 | Comp. |
| | | | | | | | | | | | 4, 5, 6 | 127 | | | | | |
| 3 | 145 | 4 | 35 | 40 | 1-6 | 110 | 1-6 | 110 | 1-6 | 125 | 1, 2, 3 | 123 | 0.055 | −0.050 | 0.052 | 5.0 | Comp. |
| | | | | | | | | | | | 4, 5, 6 | 127 | | | | | |
| 4 | 145 | 4 | 25 | 70 | 1-6 | 110 | 1-6 | 110 | 1-6 | 125 | 1, 2, 3 | 123 | 0.061 | −0.058 | 0.054 | 5.0 | Comp. |
| | | | | | | | | | | | 4, 5, 6 | 127 | | | | | |
| 5 | 100 | 8 | 25 | 40 | 1-6 | 110 | 1-6 | 110 | 1-6 | 125 | 1, 2, 3 | 123 | 0.059 | −0.054 | 0.052 | 5.0 | Comp. |
| | | | | | | | | | | | 4, 5, 6 | 127 | | | | | |
| 6 | 100 | 4 | 35 | 40 | 1-6 | 110 | 1-6 | 110 | 1-6 | 125 | 1, 2, 3 | 123 | 0.063 | −0.061 | 0.057 | 4.0 | Comp. |
| | | | | | | | | | | | 4, 5, 6 | 127 | | | | | |
| 7 | 100 | 4 | 25 | 70 | 1-6 | 110 | 1-6 | 110 | 1-6 | 125 | 1, 2, 3 | 123 | 0.064 | −0.056 | 0.054 | 4.0 | Comp. |
| | | | | | | | | | | | 4, 5, 6 | 127 | | | | | |
| 8 | 145 | 8 | 35 | 40 | 1-6 | 110 | 1-6 | 110 | 1-6 | 125 | 1, 2, 3 | 123 | 0.055 | −0.052 | 0.052 | 5.0 | Comp. |
| | | | | | | | | | | | 4, 5, 6 | 127 | | | | | |
| 9 | 145 | 8 | 25 | 70 | 1-6 | 110 | 1-6 | 110 | 1-6 | 125 | 1, 2, 3 | 123 | 0.060 | −0.062 | 0.060 | 4.0 | Comp. |
| | | | | | | | | | | | 4, 5, 6 | 127 | | | | | |
| 10 | 145 | 4 | 35 | 70 | 1-6 | 110 | 1-6 | 110 | 1-6 | 125 | 1, 2, 3 | 123 | 0.057 | −0.054 | 0.051 | 5.0 | Comp. |
| | | | | | | | | | | | 4, 5, 6 | 127 | | | | | |
| 11 | 100 | 8 | 35 | 40 | 1-6 | 110 | 1-6 | 110 | 1-6 | 125 | 1, 2, 3 | 123 | 0.055 | −0.052 | 0.052 | 5.0 | Comp. |
| | | | | | | | | | | | 4, 5, 6 | 127 | | | | | |

TABLE 5-continued

| Experiment No. | Thermal Treatment Temp (° C.) | Tension (kg/cm²) | Time (min) | Tension* (kg/cm²) | PHU 1-6 | PHU ° C. | PHL 1-6 | PHL ° C. | HDU 1-6 | HDU ° C. | HDL 1-6 | HDL ° C. | Δa (angle) | Δb (angle) | Δc (angle) | Moire | Remark |
|---|---|---|---|---|---|---|---|---|---|---|---|---|---|---|---|---|---|
| 12 | 100 | 8 | 25 | 70 | 1-6 | 110 | 1-6 | 110 | 1-6 | 125 | 1, 2, 3<br>4, 5, 6 | 123<br>127 | 0.058 | −0.057 | 0.054 | 5.0 | Comp. |
| 13 | 100 | 4 | 35 | 70 | 1-6 | 110 | 1-6 | 110 | 1-6 | 125 | 1, 2, 3<br>4, 5, 6 | 123<br>127 | 0.062 | −0.061 | 0.060 | 4.0 | Comp. |
| 14 | 145 | 8 | 35 | 70 | 1-6 | 110 | 1-6 | 110 | 1-6 | 125 | 1, 2, 3<br>4, 5, 6 | 123<br>127 | 0.063 | −0.059 | 0.058 | 4.0 | Comp. |
| 15 | 100 | 8 | 35 | 70 | 1-6 | 110 | 1-6 | 110 | 1-6 | 125 | 1, 2, 3<br>4, 5, 6 | 123<br>127 | 0.059 | −0.062 | 0.060 | 4.0 | Comp. |
| 16 | 120 | 4 | 25 | 40 | 1-6 | 110 | 1-6 | 110 | 1-6 | 125 | 1, 2, 3<br>4, 5, 6 | 123<br>127 | 0.028 | −0.028 | 0.026 | 7.0 | Inv. |
| 17 | 145 | 4 | 25 | 40 | 1-6 | 110 | 1-6 | 110 | 1-6 | 125 | 1, 2, 3<br>4, 5, 6 | 123<br>127 | 0.025 | −0.025 | 0.024 | 7.0 | Inv. |
| 18 | 190 | 4 | 25 | 40 | 1-6 | 110 | 1-6 | 110 | 1-6 | 125 | 1, 2, 3<br>4, 5, 6 | 123<br>127 | 0.027 | −0.027 | 0.027 | 7.0 | Inv. |
| 19 | 145 | 2 | 25 | 40 | 1-6 | 110 | 1-6 | 110 | 1-6 | 125 | 1, 2, 3<br>4, 5, 6 | 123<br>127 | 0.025 | −0.024 | 0.024 | 7.0 | Inv. |
| 20 | 145 | 6 | 25 | 40 | 1-6 | 110 | 1-6 | 110 | 1-6 | 125 | 1, 2, 3<br>4, 5, 6 | 123<br>127 | 0.027 | −0.027 | 0.026 | 7.0 | Inv. |
| 21 | 145 | 4 | 15 | 40 | 1-6 | 110 | 1-6 | 110 | 1-6 | 125 | 1, 2, 3<br>4, 5, 6 | 123<br>127 | 0.026 | −0.025 | 0.025 | 7.0 | Inv. |
| 22 | 145 | 4 | 30 | 40 | 1-6 | 110 | 1-6 | 110 | 1-6 | 125 | 1, 2, 3<br>4, 5, 6 | 123<br>127 | 0.024 | −0.023 | 0.024 | 7.0 | Inv. |
| 23 | 145 | 4 | 10 | 40 | 1-6 | 110 | 1-6 | 110 | 1-6 | 125 | 1, 2, 3<br>4, 5, 6 | 123<br>127 | 0.054 | −0.052 | 0.050 | 5.0 | Comp. |
| 24 | 145 | 4 | 25 | 20 | 1-6 | 110 | 1-6 | 110 | 1-6 | 125 | 1, 2, 3<br>4, 5, 6 | 123<br>127 | 0.022 | −0.023 | 0.024 | 7.0 | Inv. |
| 25 | 145 | 4 | 25 | 60 | 1-6 | 110 | 1-6 | 110 | 1-6 | 125 | 1, 2, 3<br>4, 5, 6 | 123<br>127 | 0.027 | −0.028 | 0.026 | 7.0 | Inv. |
| 26 | 145 | 4 | 25 | 40 | 1-6 | 110 | 1-6 | 110 | 1-6 | 125 | 1, 2<br>3, 4<br>5, 6 | 123<br>126<br>129 | 0.011 | −0.011 | 0.011 | 8.0 | Inv. |
| 27 | 145 | 4 | 25 | 40 | 1-6 | 110 | 1-6 | 110 | 1, 2<br>3, 4<br>5, 6 | 122<br>124<br>127 | 1, 2<br>3, 4<br>5, 6 | 122<br>124<br>127 | 0.010 | −0.010 | 0.010 | 8.0 | Inv. |

*Tension at the time of coating the image forming layer

EFFECT OF THE INVENTION

According to this invention, there can be provided a method for processing photothermographic materials, leading to improved dimensional stability and no moire of images after being processed. Disclosed embodiment can be varied by a skilled person without departing from the spirit and scope of the invention.

What is claimed is:

1. A method for processing a photothermographic material comprising the step of:

subjecting the photothermographic material to light exposure and then, subjecting the photothermographic material to heat development by the use of a thermal processing apparatus, wherein the photothermographic material comprises a support, organic silver salt particles, light sensitive silver halide grains, a reducing agent and a contrast increasing agent; and after being subjected to heat development, the photothermographic material exhibits a distortion of not more than 0.03 degree, and wherein the thermal processing apparatus comprises a heat-developing section to heat-develop the photothermographic material, the heat-developing section contains at least three heaters which are independently capable of controlling temperature and are arranged vertically in line with each other and in the direction substantially vertical to the transporting direction of the photothermographic material.

2. The processing method of claim 1, wherein the thermal processing apparatus further comprises a cooling section to cool the heat-developed photothermographic material, and the cooling section contains at least two coolers which are independently capable of controlling temperature.

3. The processing method of claim 2, wherein the two coolers are arranged vertically in line with each other and in the direction substantially vertical to the transporting direction of the photothermographic material.

4. The processing method of claim 1, wherein the photothermographic material comprises an image forming layer, the image forming layer comprises the organic silver salt particles, the light sensitive silver halide particles and a binder, and at least 50% by weight of the binder is accounted for by a polymer latex exhibiting a glass transition point of less than 40° C.

5. The processing method of claim 1, wherein the photothermographic material comprises an image forming layer, the image forming layer comprises the organic silver salt particles, the light sensitive silver halide particles and a binder, and at least 50% by weight of the binder is accounted for by a polymer latex exhibiting a glass transition point of not less than 40° C.

6. The processing method of claim 1, wherein after being subjected to heat development, the photothermographic material exhibits a distortion of not more than 0.017 degree.

7. The processing method of claim 1, wherein said support is one which was previously subjected to a thermal treatment at a temperature of 110 to 190° C. over a period of 15 to 30 min., while being transported under a tension of 2 to 6 $kg/cm^2$.

8. The processing method of claim 7, wherein the photothermographic material comprises an image forming layer; the image forming layer is coated on the support and wound up at a tension of 20 to 60 $kg/cm^2$.

9. The processing method of claim 1, wherein the thermal processing apparatus further comprises a pre-heating section for pre-heating the photothermographic material prior to heat development.

10. A thermal processing apparatus for heat-developing a photothermographic material comprising a heat-developing section to heat-develop the photothermographic material, the heat-developing section having at least three heaters, wherein the three heaters are independently capable of controlling temperature and arranged vertically in line with each other and in the direction of the photothermographic material.

11. The thermal processing apparatus of claim 10, wherein the apparatus further comprises a cooling section to cool the heat-developed photothermographic material, the cooling section having at least two coolers; and the two coolers are independently capable of controlling temperature and arranged vertically in line with each other and in the direction substantially vertical to the transporting direction of the photothermographic material.

12. The thermal processing apparatus of claim 10, wherein the thermal processing apparatus further comprises a pre-heating section for pre-heating the photothermographic material prior to heat development.

* * * * *